US010245207B2

(12) United States Patent
Avni

(10) Patent No.: US 10,245,207 B2
(45) Date of Patent: Apr. 2, 2019

(54) DEVICES FOR FUNCTIONAL REVASCULARIZATION BY ALTERNATING PRESSURE

(75) Inventor: Yuval Avni, Tel Aviv (IL)

(73) Assignee: VASCUACTIVE LTD., Hertzliya (IL)

( * ) Notice: Subject to any disclaimer, the term of this patent is extended or adjusted under 35 U.S.C. 154(b) by 955 days.

(21) Appl. No.: 13/501,179

(22) PCT Filed: Oct. 11, 2010

(86) PCT No.: PCT/IL2010/000823
§ 371 (c)(1),
(2), (4) Date: May 1, 2012

(87) PCT Pub. No.: WO2011/042909
PCT Pub. Date: Apr. 14, 2011

(65) Prior Publication Data

US 2012/0238924 A1 Sep. 20, 2012

Related U.S. Application Data

(60) Provisional application No. 61/370,859, filed on Aug. 5, 2010, provisional application No. 61/367,423, filed
(Continued)

(51) Int. Cl.

| | |
|---|---|
| ***A61H 7/00*** | (2006.01) |
| ***A61H 9/00*** | (2006.01) |
| ***A61H 23/02*** | (2006.01) |

(52) U.S. Cl.
CPC ..... *A61H 9/0092* (2013.01); *A61H 23/0263* (2013.01); *A61H 2201/0207* (2013.01);
(Continued)

(58) Field of Classification Search
CPC ..... A61H 9/0092; A61H 23/0263; A61H 2201/0207; A61H 2201/10;
(Continued)

(56) References Cited

U.S. PATENT DOCUMENTS

| | | | |
|---|---|---|---|
| 3,370,584 | A | 2/1968 | Girten |
| 5,636,643 | A | 6/1997 | Argenta et al. |

(Continued)

OTHER PUBLICATIONS

International Search Report and Written Opinion dated Feb. 18, 2011 in corresponding International Application No. PCT/IL2010/000823.

*Primary Examiner* — Quang D Thanh
(74) *Attorney, Agent, or Firm* — The Roy Gross Law Firm, LLC; Roy Gross

(57) ABSTRACT

The present invention discloses a device for administering intermittent pneumatic compression (IPC) and Protocols of Artificially Induced Oscillations (PAIO) useful in alleviating peripheral circulatory disorders of a treated organ, comprising a wearable body portion enclosure (BPE) adapted to contact said treated organ, said BPE comprising: one or more balloons adapted to be inflated and deflated for creating said IPC; one or more pressure sources in fluid communication with said balloons by way of one or more valves; one or more vibrating elements adapted to produce PAIO; a controlling unit adapted to operate said pressure sources, and to operate said vibrating elements. The IPC and PAIO may be individually administered to said treated organ according to predetermined protocols.

12 Claims, 17 Drawing Sheets

Related U.S. Application Data on Jul. 25, 2010, provisional application No. 61/250,527, filed on Oct. 11, 2009, provisional application No. 61/250,526, filed on Oct. 11, 2009.

(52) U.S. Cl.
CPC .... *A61H 2201/10* (2013.01); *A61H 2201/165* (2013.01); *A61H 2201/5002* (2013.01); *A61H 2205/10* (2013.01); *A61H 2230/25* (2013.01); *A61H 2230/30* (2013.01); *A61H 2230/50* (2013.01); *A61H 2230/65* (2013.01)

(58) Field of Classification Search
CPC ..... A61H 2201/165; A61H 2201/5002; A61H 2230/65; A61H 2230/25; A61H 2230/30; A61H 2230/50; A61H 2205/10
USPC ..... 601/6, 9, 10, 11, 148–153
See application file for complete search history.

(56) References Cited

U.S. PATENT DOCUMENTS

| | | | | |
|---|---|---|---|---|
| 5,645,081 | A | 7/1997 | Argenta et al. | |
| 6,273,866 | B2 * | 8/2001 | Thomas et al. | 601/151 |
| 2002/0058892 | A1 | 5/2002 | Young | |
| 2002/0091344 | A1 * | 7/2002 | Thomas et al. | 601/148 |
| 2003/0212357 | A1 | 11/2003 | Pace | |
| 2006/0111652 | A1 | 5/2006 | McLeod | |
| 2007/0038165 | A1 | 2/2007 | Trandafir et al. | |
| 2007/0219513 | A1 | 9/2007 | Lina et al. | |
| 2008/0033307 | A1 | 2/2008 | Baudoin et al. | |
| 2009/0012434 | A1 * | 1/2009 | Anderson | 601/6 |

* cited by examiner

Alternating vacuum pressure pulses and the rebound effect

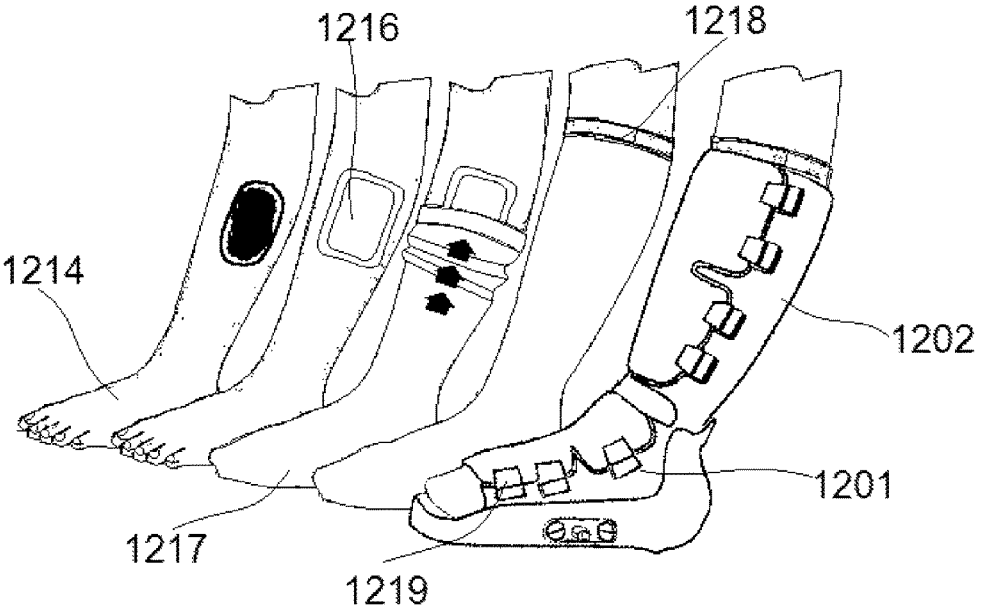
1216
1218
1214
1202
1201
1217
1219

Examples of Protocols and sub protocols

| Plantar and Calf device | one session | | |

DEVICES FOR FUNCTIONAL REVASCULARIZATION BY ALTERNATING PRESSURE

CROSS REFERENCE TO RELATED APPLICATIONS

This application is a U.S. National Phase filing under 35 U.S.C. 371 of International (PCT) Patent Application No. PCT/IL2010/000823, filed Oct. 11, 2010, which claims priority from U.S. Provisional Patent Application No. 61/370,859, filed Aug. 5, 2010, U.S. Provisional Patent Application No. 61/367,423, filed Jul. 25, 2010, U.S. Provisional Patent Application No. 61/250,526, filed Oct. 11, 2009, and U.S. Provisional Patent Application No. 61/250,527, filed Oct. 11, 2009. All of these applications are hereby incorporated by reference in their entirety.

FIELD OF THE INVENTION

The invention pertains to the field of means and methods of treating peripheral circulatory conditions, more specifically, means and methods of treating (i) peripheral vascular disease of the limb, whether caused by hypertension, diabetes or other etiologies; (ii) diabetic foot ulcers; and (iii) venous insufficiency.

BACKGROUND OF THE INVENTION

Peripheral Vascular Disease (PVD) is a clinical state caused by occlusion of arteries. It is therefore also known as Peripheral Arterial (Occlusive) Disease (PAD, PAOD). Physical examination that usually shows diminished or absent foot pulses, low Ankle-Brachial Pressure Index (ABI) (normal ABI≈1, pathological typically lower than 0.7). Imaging: Doppler ultrasonography, angiography and CT.

Treatment includes several available measures today: Conservative measures: smoking cessation, low-lipid diet, physical exercise, medications (for blood dilution, cholesterol chelation); Surgical revascularization: available options include: balloon angioplasty, for solitary lesions in large arteries, bypass grafting, for extended lesions and for fully or almost-fully occluded arteries, Plaque excision, Ulcers require additional local treatment, such as off-loading, debridement, dressings, Gangrene most often requires amputation.

Diabetic Foot: Prolonged Diabetes Mellitus (D.M.) affects the nervous and vascular systems in multiple ways that give rise to pathologies in the patient's foot including neuropathy and vascular disease. Ultimately, these pathologies, when combined with trauma to the skin, including even mild trauma caused by low pressure and friction of the shoe, will cause ulceration, possible infection of these ulcers, and gangrene. Failure to treat these often results in amputation. It is thought that worldwide around half of all foot ulcers and amputations in people with diabetes could be prevented.

Initial ulcer treatment is based on the following principles: Off-loading: bed rest, total contact cast, wheelchair, crutches, etc; Debridement (skin removal): sharp, enzymatic, etc; Moisture balance and dressings; Advanced wound management: Negative Pressure Wound Therapy (NPWT), growth factors, bioengineered tissue, etc.

Other therapeutic techniques include Negative pressure wound therapy (NPWT) and Vacuum Assisted Closure (V.A.C.).

Hyperbaric Oxygen Therapy: Intermittent Pneumatic Compression (I.P.C., ArtAssist®)—IPC is a technique that applies repeated compression of the lower limb in order to augment blood flow to these organs. Vibration—In 2007, Nakagami et al. found that applying vibrations at a fixed frequency of 47 Hz to the skin of the ear of mice induced vasodilation and an increase of perfusion.

Negative Pressure Wound Therapy (NPWT): NWPT is a method of treating tissue damage which involves applying a negative pressure over a wound, in order to encourage migration of epithelial and subcutaneous tissue for a time sufficient to close the wound.

Nevertheless, there is no system disclosed which can integrate effectively the broad combination of effective therapies required for the alleviation of diabetic lesions and ulcers on the lower limbs, or the consequences of venous insufficiency (CVI). U.S. Pat. No. 5,645,081 and U.S. Pat. No. 5,636,643 to ARGENTA provide Negative Wound Pressure Therapy type methods (NWTP) for treating tissue damage by applying negative pressures to the open wound constantly or cyclically.

Bio-Electric Stimulation Therapy (BEST) or micro current electro therapy (MET) documented beneficial effects at the cellular level including increase in ATP production by up to 500%, enhanced transmembrane transport, which include: amino acids, especially proline (important in connective tissue repair) and stimulation of fibroblasts. Some embodiments of the present invention disclose means for administering BEST sub protocols or MET sub protocols.

There is therefore a need to provide means and methods for promoting functional revascularisation and for treating diabetic foot ulcers and the complications thereof. Furthermore, there is a long felt and unmet need to provide integration of novel and current therapeutic protocols to the above stated aims.

SUMMARY OF THE INVENTION

It is one object of the present invention to provide a device for administering intermittent pneumatic compression (IPC) and Protocols of Artificially Induced Oscillations (PAID) useful in alleviating peripheral circulatory disorders of a treated organ and in wound healing of a treated organ, comprising a wearable body portion enclosure (BPE) adapted to contact the treated organ, the BPE comprising:

a. one or more balloons adapted to be inflated and deflated for creating the IPC;
b. one or more pressure sources in fluid communication with the balloons by way of one or more valves;
c. one or more vibrating elements adapted to produce PAID;
d. a controlling unit adapted to operate the pressure sources, and to operate the vibrating elements;

It is within the scope of the present invention that the IPC and PAIO may be individually administered to the treated organ according to predetermined protocols.

It is another object of the present invention to provide the device as defined above, wherein the protocols include silent periods and active periods as herein described.

It is another object of the present invention to provide the device as defined above, wherein the BPE takes a form selected from the group consisting of: sock (217), boot, shoe, sandal, bandage, pad, dressing, cast, flexible cast, shirt, girdle, pants, shorts, sleeve, tube.

It is another object of the present invention to provide the device as defined above, additionally provided with a selector adapted to open and close one or more of the valves, thereby selecting one or more of the balloons to be put in fluid communication with the pressure sources.

It is another object of the present invention to provide the device as defined above, where the treated organ is selected from the group consisting of: the foot, the plantar aspect of the foot, the ankle, the knees, the calf, the thigh, the abdomen, the gluteal region, the back, the chest, the hand, the arm, the nose, the neck, the shoulders, and the elbow.

It is another object of the present invention to provide the device as defined above, additionally provided with a porous inner layer adapted to allow forced fluid exchange with an external fluid supply, the fluid being selected from the group consisting of: oxygen, ozone, NO, air, vacuum, medicated fluids, saline solution, Ringer Lactate solution, and other buffered solutions.

It is another object of the present invention to provide the device as defined above, where the inner layer is comprised of a spray-on biocompatible foam.

It is another object of the present invention to provide the device as defined above, additionally provided with sensors selected from a group consisting of: temperature sensors, tissue oxygenation sensors, tissue $CO_2$ level sensors, P(NO) sensors, $P(O_3)$ sensors, systolic blood pressure sensors, diastolic blood pressure sensors, blood flow rate sensors, humidity sensors, blood viscosity sensors, blood perfusion sensors, conductivity sensors, and voltage sensors.

It is another object of the present invention to provide the device as defined above, further provided with electrodes adapted for stimulating the skin with electrical voltage.

It is another object of the present invention to provide the device as defined above, wherein the IPC is adapted to generate a rebound effect of the treated tissue by applying pressure on the treated organ with a frequency which is higher than the natural frequency of rebound of the treated organ.

It is another object of the present invention to provide the device as defined above, wherein the vibrating elements are operated at a set of frequencies ranging from about 0.5 Hz to about 500 Hz.

It is another object of the present invention to provide the device as defined above, wherein the device is adapted for mounting on a patient's footwear.

It is another object of the present invention to provide a method useful for alleviating peripheral circulatory disorders of a treated organ and for wound healing in a the treated organ, comprising steps of:

a. placing one or more gas-impermeable balloon(s) into contact with one or more areas of the treated organ, the balloons being integrated within a wearable body part enclosure (BPE);
b. placing one or more pressure sources in fluid communication with the gas impermeable balloons by way of one or more valves;
c. placing one or more vibrating elements adapted to produce artificially induced oscillations in direct or indirect mechanical contact with one or more areas of treated organ;
d. administering intermittent pneumatic compression (IPC) and artificially induced oscillations (PAIO) by means of a controlling unit adapted to operate the balloons by means of the valves, and operate the vibrating elements;

whereby IPC and PAIO may be individually administered to the treated organ according to predetermined protocols.

It is another object of the present invention to provide a device for administering to a treated organ Protocols of Artificially Induced Oscillations (PAIO) each of which is characterized by a predetermined frequency, pressure, amplitude, wave form, volume and duration according to a protocol; the device comprising:

a. a plurality of regulators each of which is adapted to define a PAIO with an individual frequency, pressure amplitude, wave form, volume and duration;
b. means for producing the protocol of the defined individual PAIOs; and,
c. effectors adapted to introduce the protocol of produced PAIOs to impinge the treated organ;

wherein the therapeutic protocol of PAIOs comprises one or more different individual time resolved PAIOs and their harmonic frequencies.

It is another object of the present invention to provide the device as defined above, wherein the device is additionally provided with means for producing at least one set of predetermined humming oscillations the humming oscillations provided independently or contemporaneously with the series of PAIOs.

It is another object of the present invention to provide the device as defined above, wherein the device is additionally provided with means for massaging and/or compressing the treated organ of a patient in a predetermined manner.

It is another object of the present invention to provide the device as defined above, wherein the PAIOs are characterised by parameters selected from a group consisting of Frequency, Waveform, Pressure amplitude, Volume and Duration.

It is another object of the present invention to provide the device as defined above, wherein the Frequency of PAIOs is selected from a group consisting of about 0.5 Hz to about 5.0 Hz, about 5.0 Hz to about 10 Hz, about 10 Hz to about 20 Hz, about 20 Hz to about 30 Hz, about 30 Hz to about 40 Hz, about 40 Hz to about 50 Hz, about 50 Hz to about 60 Hz, about 60 Hz to about 70 Hz, about 70 Hz to about 80 Hz, about 80 Hz to about 90 Hz, about 90 Hz to about 100 Hz, any integer multiples thereof.

It is another object of the present invention to provide the device as defined above, wherein the protocol is dependent upon the patient's natural involuntary or voluntary functions.

It is another object of the present invention to provide the device as defined above, wherein the PAIOs parameters are selectable on the basis of clinical efficacy.

It is another object of the present invention to provide a device for administering treatment protocols useful in alleviating peripheral circulatory disorders of the lower limb the device comprising BPEs structurally based on biocompatible medical foams which set in situ.

It is another object of the present invention to provide the device as defined above, additionally comprising an external supplementary layer, characterised by setting as a plush sponge wherein the plush sponge is adapted such that mechanical vibrators or any other effectors may be inserted into the layers and aforementioned protocols applied.

It is another object of the present invention to provide a device for administering intermittent pneumatic compression (IPC) and Protocols of Artificially Induced Oscillations (PAID) useful in alleviating peripheral circulatory disorders of a patient's limb, especially the foot comprising an active foot rest (AFR) adapted to contact at least a portion of the foot, the AFR comprising:

a. one or more balloons adapted to be inflated and deflated;
b. one or more pressure sources in fluid communication with the balloons by way of one or more valves;
c. one or more vibrating elements adapted to produce artificially induced oscillations;

d. a controlling unit adapted to inflate and deflate the balloons by means of the valves, and operate the vibrating elements;

It is within the scope of the present invention that the IPC and PAIO may be individually administered to the areas of the body according to predetermined protocols.

It is another object of the present invention to provide the device as defined above, further adapted to move the lower limb in a predetermined manner as part of a treatment.

It is another object of the present invention to provide the device as defined above, wherein the active foot rest is adapted to produce alterations in any angle from the group consisting of the angle of the sole and heel of the foot, knee joint, associated blood vessels and nerves of the lower limb and foot.

It is another object of the present invention to provide the device as defined above, wherein the device is adapted such that the angular movement of the foot produces a muscle pump effect, beneficial to improving the circulation.

It is another object of the present invention to provide the device as defined above, wherein the device is adapted such that the user places his foot on the foot device when the device is in use.

It is another object of the present invention to provide the device as defined above, wherein the device is provided with motor and gears.

It is another object of the present invention to provide the device as defined above, wherein the device is adapted such that the user may place his foot on the foot pad of the device and is able to select only the foot segment or both segments according to need by means of a selector and control of the pressure levels is achieved by means of a pressure selector.

It is another object of the present invention to provide the device as defined above, wherein the device is provided with internal components such that the Foot Treatment Device includes an IPC balloon, vibrator and vibrator housing, foot stabilizer balloon that tracks the foot position, a foot stabilizer balloon pump, IPC balloon pump, batteries, controllers and further pumps.

It is another object of the present invention to provide the device as defined above, including a rest for the foot designed or moulded more or less to the contours of the patient's foot and heel further including an inflatable or preformed balloon of a predetermined pressure.

It is another object of the present invention to provide the device as defined above, further including an IPC operative at various controlled pressures for effecting emptying of veins and encouraging and improving arterial blood flow in the treatment portion of the limb, in order to provide therapy to the tissues while they are amply supplied with oxygen.

It is another object of the present invention to provide the device as defined above, wherein the AFR is arranged as a pair in a bicycle like configuration.

It is another object of the present invention to provide a device for administering intermittent pneumatic compression (IPC) and negative pressure wound therapy (NPWT) to a treated organ, comprising a wearable body part enclosure (BPE) wherein the BPE comprises:

i. an inner flexible porous spongy layer;

ii. vacuum means in fluid communication with the inner layer;

iii. a middle non permeable layer;

iv. an outer inflatable layer;

v. pressure means adapted for inflating the outer inflatable layer;

such that both intermittent pneumatic compression and negative pressure wound therapy may be administered simultaneously.

It is another object of the present invention to provide the device as defined above, wherein the device additionally comprises a controller for controlling the vacuum and pressure means.

It is another object of the present invention to provide the device as defined above, for administering either intermittent pneumatic compression (IPC) or negative pressure wound therapy (NPWT), comprising a wearable body part enclosure (BPE) further comprising either vacuum means in fluid communication with the inner layer or pressure means adapted for inflating the outer inflatable layer; the device additionally comprising means for administering one or more protocol selected from the group consisting of: heating, fluid perfusion, and electrical stimulation, such that either intermittent pneumatic compression or negative pressure wound therapy can be administered together with any protocol selected from the group consisting of heating, fluid perfusion, and electrical stimulation It is another object of the present invention to provide the device as defined above, wherein the vacuum and pressure means are adapted for intermittent operation, allowing inactive periods and active periods as herein described.

It is another object of the present invention to provide the device as defined above, where the device takes a form selected from the group consisting of: sock, boot, shoe, sandal, bandage, pad, dressing, cast, flexible cast, shirt, girdle, pants, shorts, sleeve, and tube.

It is another object of the present invention to provide the device as defined above, additionally provided with valves between the inner layer and the vacuum means, and between the outer layer and the pressure means.

It is another object of the present invention to provide the device as defined above, additionally provided with a selector adapted to open and close one or more the valves, thereby selecting one or more of the balloons to be put in fluid communication with the pressure sources.

It is another object of the present invention to provide the device as defined above, where the treated organ is selected from the group consisting of: the foot, the plantar aspect of the foot, the ankle, the knees, the calf, the thigh, the abdomen, the gluteal region, the back, the chest, the hand, the arm, the nose, the neck, the shoulders, and the elbow.

It is another object of the present invention to provide the device as defined above, wherein the porous inner layer is adapted to allow forced fluid exchange with an external fluid supply, the fluid being selected from the group consisting of: oxygen, ozone, NO, air, vacuum, medicated fluids, saline solution, Ringer Lactate solution, and other buffered solutions.

It is another object of the present invention to provide the device as defined above, wherein the inner layer is comprised of a spray-on biocompatible foam.

It is another object of the present invention to provide the device as defined above, wherein a fluid is pumped into the inner layer during periods of low pressure in the outer layer, causing the fluid to be forced into the body part during periods of high pressure in the outer layer.

It is another object of the present invention to provide the device as defined above, adapted for topical hyperbaric oxygen therapy.

It is another object of the present invention to provide the device as defined above, wherein the pressure is modulated with rapid variations of frequency higher than the natural frequency of the body part.

It is another object of the present invention to provide the device as defined above, additionally provided with sensors selected from a group consisting of: temperature sensors, $P(O_2)$ sensors, $P(CO_2)$ sensors, P(NO) sensors, $P(O_3)$ sensors, systolic blood pressure sensors, diastolic blood pressure sensors, blood flow rate sensors, temperature sensors, humidity sensors, blood viscosity sensors, blood perfusion sensors, conductivity sensors, and voltage sensors.

It is another object of the present invention to provide the device as defined above, where the protocols may be modulated according to data provided by the sensors.

It is another object of the present invention to provide the device as defined above, where the inner, middle, and outer layers are comprised of disposable pads.

It is another object of the present invention to provide the device as defined above, further comprising vibration means embedded within the BPE and control means adapted to operate the vibrating means in the control unit.

It is another object of the present invention to provide the device as defined above, wherein the vibration frequency of the vibration means is selected from a group consisting of about 0.5 Hz to about 5.0 Hz, about 5.0 Hz to about 10 Hz, about 10 Hz to about 20 Hz, about 20 Hz to about 30 Hz, about 30 Hz to about 40 Hz, about 40 Hz to about 50 Hz, about 50 Hz to about 60 Hz, about 60 Hz to about 70 Hz, about 70 Hz to about 80 Hz, about 80 Hz to about 90 Hz, about 90 Hz to about 100 Hz, and any integer multiples thereof.

It is another object of the present invention to provide the device as defined above, wherein any of the selected frequencies is deliverable with its corresponding overtones or multiples thereof.

It is another object of the present invention to provide the device as defined above, further comprising electrodes adapted for electrical stimulation of the body part.

It is another object of the present invention to provide the device as defined above, further comprising heating means adapted for heating the body part, the heating means selected from the group consisting of: electrical heating means, and chemical heating means.

It is another object of the present invention to provide the device as defined above, wherein the pressure is varied at a frequency faster than the natural frequency of rebound of the tissues of the body part.

It is another object of the present invention to provide the device as defined above, wherein the pressure is applied in a direction largely normal to the body part.

It is another object of the present invention to provide the device as defined above, additionally comprising an external supplementary layer, characterized by setting as a plush sponge wherein the plush sponge is adapted such that Mechanical vibrators or any other effectors may be inserted into the layers and aforementioned protocols applied.

It is another object of the present invention to provide the device as defined above, adapted for increasing diffusive fluxes by means of creating spatial pressure gradients with the pressure means and vacuum means.

It is another object of the present invention to provide a device for administering treatment protocols useful in alleviating peripheral circulatory disorders of the lower limb the device comprising a wearable lower limb enclosure (LLE) adapted to administer a plurality of sub protocols, comprising i. an inner flexible porous spongy layer for covering a dressed or undressed wound ii. a middle non permeable layer for sealing the wound iii. a pressure means for producing a negative pressure condition over the wound according to a predetermined sub protocol, via the inner flexible porous layer and/or a pressure means for producing a positive pressure condition over the wound according to a predetermined sub protocol (DrP)

iv. an outer inflatable layer

It is within the scope of the present invention that the outer layer comprises an inflatable/deflatable balloon like layer for compressing, squeezing or administering Intermittent Pneumatic Compression (IPC) to the lower limb according to a Compression (ComP) protocol.

BRIEF DESCRIPTION OF THE DRAWINGS

The present invention discloses a novel device and method of treating PVD (Peripheral Vascular Disease), chronic wounds and ulcers, diabetic foot and venous insufficiency therapy. As will be seen, the invention is presented in several modes or embodiments including, shoes, sleeves and pads which combine several types of protocols and sub protocols for treating the above mentioned conditions. It will be apparent to a person skilled in the art that other conditions of the limbs may benefit from the device and protocols herein described.

In order to understand the invention and to see how it may be implemented in practice, a plurality of embodiments is now described, by way of non-limiting example only, with reference to the accompanying drawings.

FIGS. 4*a*-4*c* illustrate another aspect of a preferred embodiment of the present invention;

FIG. 9 illustrates another aspect of a preferred embodiment of the present invention;

DETAILED DESCRIPTION OF THE INVENTION

Figure 1A:
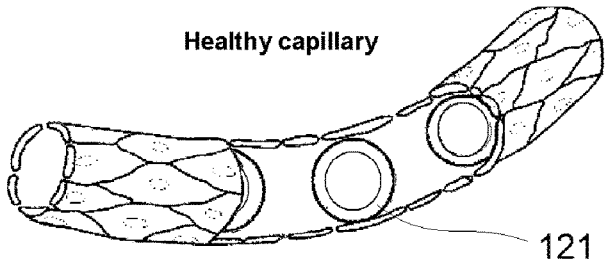
FIGS. 1*a*-1*c* illustrate damaged vein valves.

The description is provided, alongside all chapters of the present invention, so as to enable any person skilled in the art to make use of said invention. The best modes contemplated by the inventor of carrying out this invention have been set forth herein. Various modifications, however, remain apparent to those skilled in the art, since the generic principles of the present invention have been defined specifically to provide means and methods of treating a diabetic foot and venous insufficiency of the lower limbs, pressure ulcers, claudication and other disorders.

The term "protocol" hereinafter refers to a series of physical operations administered by embodiments of the device described herein. The protocol may be a combination of therapy(ies) and possibly other Protocol(s).

The term "Artificially Induced Vibration (AIV)" refers to mechanical vibration produced at some frequency and amplitude, created for example by rotation of an eccentrically mounted mass or by piezoelectric means.

The term "Artificially Induced Oscillations (AIO)" refers to any kind of physical oscillations, such as mechanical vibrations, electrical currents, etc.

The term 'protocols of artificially induced oscillation (PAIO)' refers to a protocol for administering AIO. The PAIO may be for example a predetermined consecutive set of vibrations. Each vibration may be composed of a single vibration or by a combination of several vibrations. The vibration(s) may be characterized by the following parameters: duration, frequency, amplitude, volume and waveform. According to different embodiments of the present invention, the vibrations may be separated by periods of rest in which no vibration are produced. The term 'normal', in a geometrical context, hereinafter refers to the inward radial direction. For example in the leg, the normal direction is the inward radial direction perpendicular to the skin surface, pointing from the skin surface inwards towards the bone.

The term 'revascularization' refers to a surgical procedure for reestablishment or provision of a new, additional, or augmented blood supply to a body part or organ.

The term 'functional revascularization' refers to providing functional benefit similar to revascularization by non-surgical means.

The term 'tcpO2' hereinafter refers to transcutaneous oxygen partial pressure.

The term 'tcpCO2' hereinafter refers to transcutaneous carbon dioxide partial pressure.

The term 'VascuActive device' hereinafter refers to the system and/or method of the current invention.

The term 'body portion enclosure (BPE)' hereinafter refers to a device adapted to enclose a portion of the body. Thus a shoe, boot, cast, sling, wrap, pad, and the like are all included in the term body portion enclosure.

The term 'treated organ' refers hereinafter to a predetermined area of the patient's body to which the treatment is provided by the device of the present invention. The treated organ may be for example of the following: the lower limb, any body organ, a wound, the foot, the plantar aspect of the foot, the ankle, the knees, the calf, the thigh, the abdomen, the gluteal region, the back, the chest, the hand, the arm, the nose, the neck, the shoulders, the elbow, or any combination thereof.

The present invention discloses a device and a method for:

1. Functional revascularization—the functional revascularization which is provided by the device of the present invention is a non-surgical technique adapted to improve blood circulation and blood perfusion by squeezing out blood from veins in a given area, and allowing increased flow of oxygenated arterial blood into the arterial capillaries. Moreover, the functional revascularization which is provided by the device of the present invention is aimed at causing dilation of blood vessels and to stimulating blood perfusion, leading ultimately to lowering of tissue CO2 levels and raising tissue O2 levels at the target sites (e.g., the treated organ). According to different embodiments of the present invention, the functional revascularization may be used for wound healing. The device may cause a shift of the peripheral hemodynamic balance, through diverse mechanisms of actions, including NO-mediated and neural-mediated vasodilatation, and an increase of pressure and transmembrane diffusion in the capillaries. This hemodynamic balance shift improves blood flow and metabolites transport to the periphery through an effect on macrovasculature and microvasculature.
2. Transfer, penetration, and transportation into the treated organ (e.g., a wound) of at least one of the following therapeutic modalities: drugs, gases, oxygen, ozone fluids, CO, NO, saline solution, dedication solutions, different gases, electrical stimulation, and heating. For example, this may be done by means of fluid perfusion devices by which the treated organ may be perfused/flushed with various different gas or liquid compositions such as pure oxygen, NO, medicated liquids, saline solution, etc.
3. Providing treatment to the treated organ by various internal volumes (e.g., balloons) that are connected by way of valves to vacuum, pressure, and fluid-perfusion devices. By means of inflating and deflating these volumes, positive and negative pressure can be applied to treated organ. The treatment may also be provided by vibrating mechanisms which are adapted to vibrate the treated organ.

The aim of the device is to provide at least one of the following clinical aims:

1. Functional revascularization;
2. Improved blood and lymphatic circulation, and consequently improved delivery of metabolites and gases to or from tissues;
3. Enhancement of angiogenesis;
4. Enhanced wound closure;
5. Topical oxygen therapy especially in diabetics by administering 100% oxygen at higher than atmospheric pressure, such that oxygen dissolves in the tissue in increased amounts;
6. Pain relief;
7. Facilitation of recovery from intensive workouts, and workout optimization.

According to different embodiments, the present invention provides means and method for producing different treatment protocols adapted for rehabilitation of peripheral vascular disease and/or prevention of its complications, by functional revascularization, and wound healing. Specifically, a device is provided that is capable of combining intermittent pneumatic compression (IPC) and Protocols of Artificially Induced Oscillations (PAID) provided to a treated organ (e.g., a wound area, a limb portion, etc.) in need of either improved circulation and blood perfusion, such as in a diabetic foot, or wound healing, as in a bed sore. Further capabilities of the device include options for oxygen perfusion and vacuum. For example, tailored protocols are applied which squeeze out blood from veins in a given area, allowing increased flow of oxygenated arterial blood into the arterial capillaries, whilst specific predetermined vibrations applied to the tissue area cause dilation of blood vessels and stimulate blood perfusion, leading ultimately to lowering of tissue CO2 levels and raising of tissue O2 levels at the target sites of the blood stream. Protocols are provided for epithelial stimulation, lymph flow stimulation, increased NO production and other therapeutic effects. It is within scope of the invention to use feedback to control protocols.

According to different embodiments of the present invention, a treatment protocol for wound drainage and wound healing involving application of vacuum to the wound bed, mechanical vibrations, and a protocol of massaging, compressing or Intermittent Pneumatic Compression (IPC) can be applied according to the clinical indications of the patient. Topical oxygen therapy protocols can further be integrated into the overall treatment protocol, as can drug delivery protocols. According to some embodiments, this can be provided by the device of the present invention which is a single shoe device. The novel integration of more than one therapeutic protocol will, in many cases, have a synergistic or more than additive effect on the patient's overall improvement.

Figure 1B:
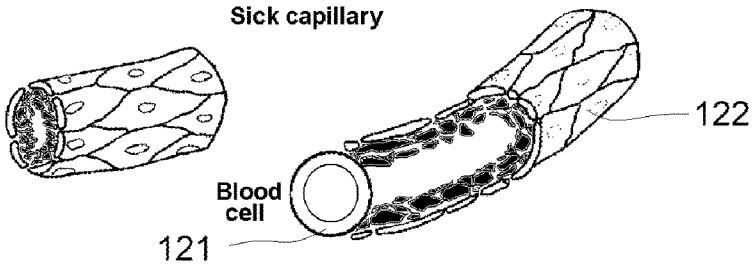
Figure 1C:
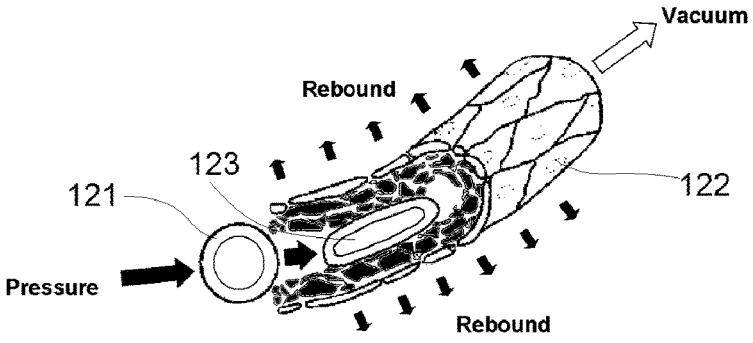

One basic operation of the device is that of squeezing the treated organ such as the plantar or calf muscle. This can have beneficial effects on the circulatory system as shown in FIGS. 1*a*-1*c* schematically. This figure presents the natural arrangement of the venous pump, assisted by the inflatable balloons 101 of an embodiment of the invention, designed to assist blood flow to the heart by balloon inflation.

FIG. 1*a* illustrates the inflation condition, when the balloon layer is exerting pressure on the venous system, thereby assisting the venous pump. In the deflation condition, the balloon layer is deflated, allowing blood to flow back into the veins. According to some embodiments, the aim of the device is to provide some combination of:

1. Intermittent pneumatic compression (IPC), whether regional (over large areas of the lower limb) or topical (over the wound area); and
2. Negative pressure wound therapy (NPWT), whether regional or topical.

In FIG. 1*b*, one possible mechanism for increased blood flow in regions undergoing IPC is illustrated. In the normal blood vessel 120, blood cells 121 travel freely. In the constricted blood vessel 122 however, the blood cell 121 is blocked due to the small diameter of the blood vessel 122. Referring to FIG. 1*c*, in the case of dilation, the blood vessel 122 will cause it to momentarily widen, admitting blood cell 123 during the dilation phase of the IPC. When the blood vessel 122 contracts to its original size the blood cell may be somewhat deformed but has in any case passed some of the obstruction. During the next cycle the cell may travel further, and in this way blood flow may be to some degree restored.

Figure 2A:
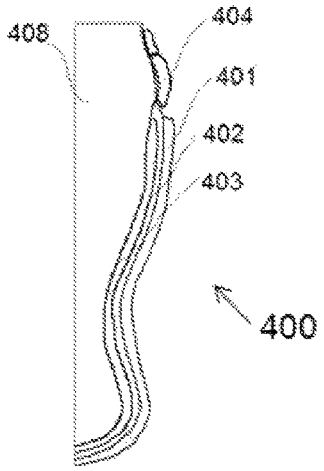
FIGS. 2*a*-2*d* illustrate an aspect of a preferred embodiment of the present invention.
Figure 2B:
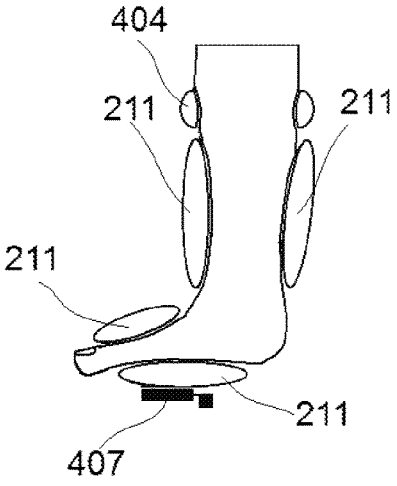
Figure 2C:
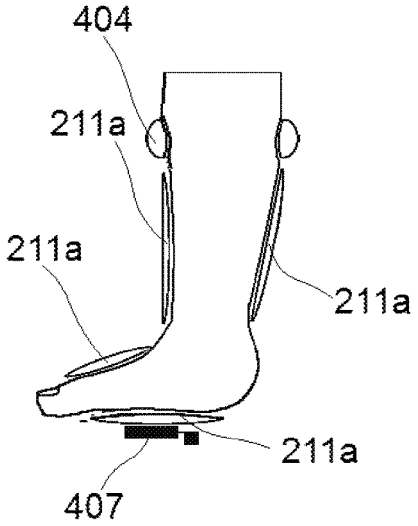
Figure 2D:
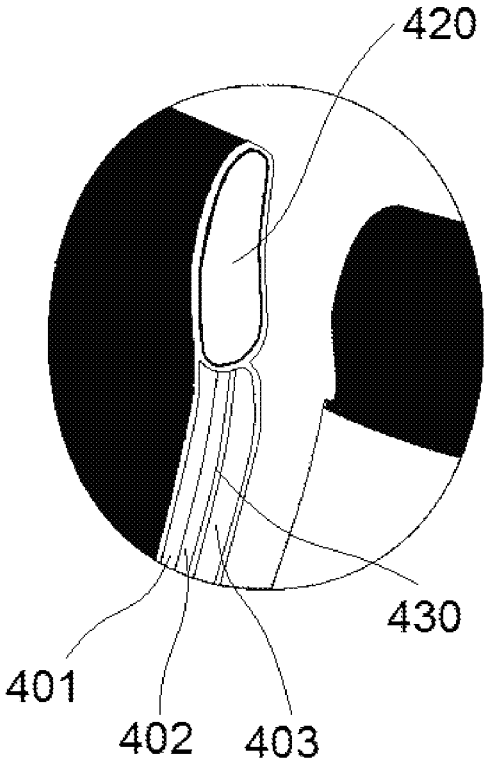
Figure 3:
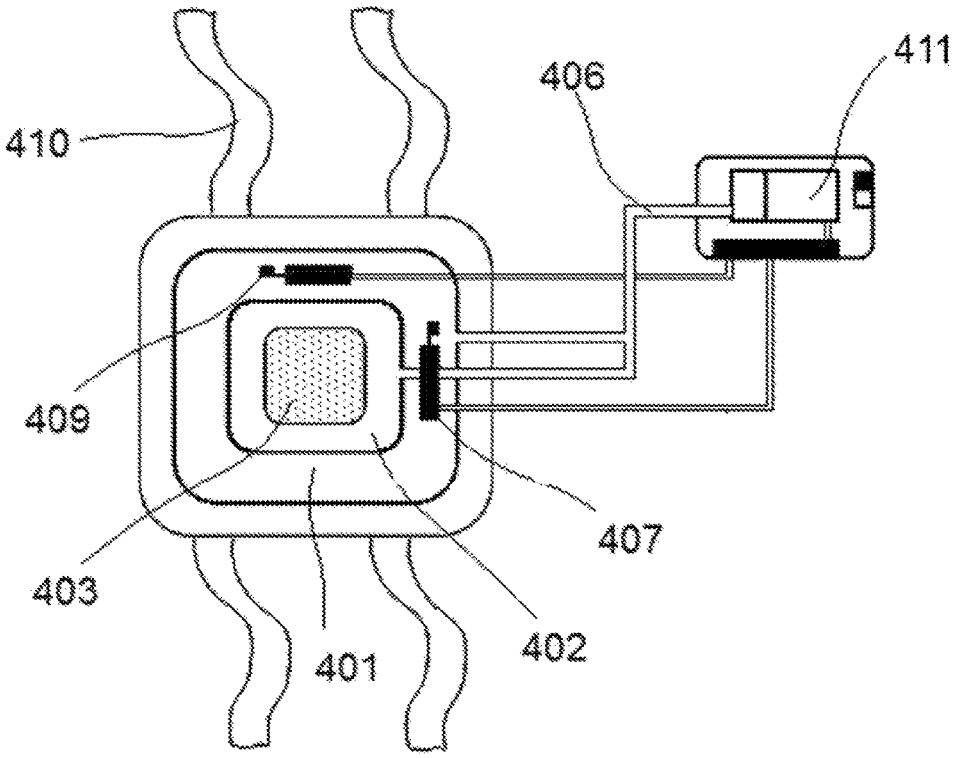
FIG. 3 illustrates another aspect of a preferred embodiment of the present invention.

Reference is now made to FIGS. 2*a* to 2*d* and 3 displaying a schematic representation of mechanical aspects of the invention. In these figures illustrated a specific embodiment of the present invention. According to this embodiment, the device of the present invention is a foot treatment device to be worn on the lower leg, in a boot-like or slipper like manner According to this embodiment, the treated organ may be the foot, the lower leg, or the lower limb. The device may be provided as a sleeve-like or bandage-like device (400 of FIG. 2*a*). The sleeve- or bandage-like embodiment may be strapped to the body using Velcro straps or buckles. In all cases, the device is provided with one or more inner volumes (e.g. 211 of FIG. 2*b*) that are in fluid communication via pressure lines (406 of FIG. 3) with pressure and/or vacuum means such as reservoirs. FIGS. 2*b* and 2*c* present inflated and deflated positions of the device. These reservoirs are kept under pressure or vacuum by means of pump 411 (FIG. 3). Various mechanical vibrators 407 and 409 may be embedded at various locations within the boot, or sleeve. These vibrators may be (for example) piezoelectric, or motors with masses eccentrically mounted upon their shafts.

Reference is now made to FIG. 3 which is a schematic representation of a preferred embodiment of the present invention. An example of an administration means is the inflatable and deflatable volume 401, depicted in FIG. 3. This volume may take the form of balloons or inflatable cuffs or pads which are tightly bound to the target area (foot, calf). A programmed protocol of squeezing, compressing or massaging is applied by a pump 409 for generating the IPC, controlled by a control unit (which may be a microcontroller, CPU, analog controller, or the like). The pump inflates/deflates portions of the inflatable balloons or cuffs according to certain protocols. The control unit administers a protocol controlling the operation of the pump as well as the vibrators. The vibrator in this example consists of a motor which rotates the eccentrically placed weights 409, causing vibration. The vibrators are actuated according to the overall therapeutic protocol which may the PAID. A region selector may be provided that allows the user to select which volume is in communication with the pump; thus for example a balloon provided in the plantar region, calf region, or combination of these may be selected for inflation/deflation by the system. The pressure level of the pump 409 and associated reservoir can be controlled by a pressure selector. The maximum pressure provided to the various body parts adjacent to the balloons can thus be varied. Additional variation of this pressure occurs through the controller which varies the pressure according to the aforementioned protocols. To achieve higher-frequency variation, shutter valves may be employed in the path between reservoir and inflated volume.

The several layers of the device are shown in cross section in FIG. 2*d*. These are the pressure layer 401, middle layer 402, heating layer 430, and inner porous layer 403. A further sealing layer 420 is provided to provide sealing of the internal volumes of the devices against the leg, such that they will maintain pressure or vacuum.

Reference is made to FIG. 3 schematically illustrating an embodiment of the present invention. The device has three layers. The inner layer 403 is sponge like and porous, and is conformable and flexible against the skin 408 of the patient's lower limb. The porous layer 403 is designed to be in direct contact with a gauze or dressing covering the wound layer or the wound bed, and in contact with the surrounding skin. The middle layer, or vacuum layer 402 is hermetically sealed to the sponge layer and is similarly conformable. In this way the wound or ulcer is hermetically isolated in a gas-tight and impermeable manner. The spongy porous layer lies on top of the dressing or gauze covering the area of the wound bed providing "blotting" capacity or capillary capacity for pus and other secretions typical of wound pathology to be soaked up and removed when a vacuum is applied to the system. A sealing layer 404 is provided to ensure an air-tight seal against the leg. This layer may itself consist of an inflatable balloon, a band of adjustable tension, an O-ring, or other sealing means as will be obvious to one skilled in the art. Grease, oil, or the like may be applied to the material of this layer 404 in order to ensure airtightness. A sealable port and vacuum line 405, 406 is connected to the porous layer from the vacuum pump, thereby providing an effective means for draining the wound, ulcer or abcess, and assisting its closure, by placing it under negative pressure. The vacuum is applied according to predetermined protocols, especially in pulses, (or sub protocols when applied together with other therapies herein described) which are optimized to elicit: Increased blood flow; Increased lymphatic circulation; Growth of new tissue such as granulation tissue, blood vessels, fibroblasts; and Cell migration (including fibroblasts) including macrophages and lymphocytes.

Mechanical vibrators are positioned at predetermined locations around the device, as seen in FIG. 3 (element 407). These vibrators deliver mechanical vibrations according to a predetermined sub protocol. The specific predetermined vibrations applied to the tissue area stimulate blood perfusion, leading to lowering of tissue CO2 levels and raising of tissue O2 levels. Protocols are provided for epithelial stimulation, lymph flow stimulation, increased NO production and other therapeutic effects. The sub protocols of mechanical vibrations also vibrate blood in the arterial system all along the leg, up to the groin region and beyond, thereby aiding the blood flow to pass through blockages. The above mentioned mechanical vibrations also vibrate the bones in a predetermined manner, which in turn vibrate surrounding tissues, to beneficial effects. In embodiments of the invention Mechanical Vibrators are provided which administer the sub protocols directly to the tissue or through pneumatic media, such as the inflatable balloons, when they are pressurized, or when they are not.

The device may be used as an appropriate first stage before surgical wound closure. An inflatable pressure layer 401 lies upon the vacuum layer 402. The pressure layer is in fluid communication 406 with a pressure source. As will be obvious to one skilled in the art, the pressure layer 401 and vacuum layer 402 can be combined into a single layer. Also visible are the flesh of the leg 408, pump 409 (not to scale), vibrators 407, in an optional embodiment shown below the first embodiment), and vacuum/pressure/fluid lines 405, 406.

Other embodiments of the present invention for the treatment of diabetic foot ulcers comprise the following: A balloon-like member and cuff, optionally with medication and drug release capabilitie; A pneumatic inflating pump; A vacuum pump; A large vibrator for providing vibrations of large magnitudes; A small vibrator for providing vibrations of small magnitudes; A computerised controller for providing predetermined vibration protocols to the aforementioned large and small vibrators.

Patients with painful foot ulcers of the ankle or calf may not be able to withstand pain which may arise from direct squeezing of the inflatable balloon on the region of the ulcer. In such cases, an inflatable/deflatable foot balloon or pad is fitted to the foot in locations such that non-ulcerated areas of the foot may be squeezed or compressed to achieve healing of the adjacent painful ulcer. This balloon is controlled by the device to administer IPC according to protocols or sub protocols.

An exemplary device comprises a special wearable boot, combining several technologies which are administered by a treatment protocol, the aforementioned Treatment Protocol itself being made up of a combination of sub-protocols, to create maximum effect for treatment of chronic ulcers.

The outer layer 401 comprises an inflatable and deflatable balloon-like space or pocket. The pocket may be divided into cells or compartments. The inflatable space may be pressurised and inflated by injection of fluid or gas, such that there is substantial compressive force exerted on the lower limb. The inflation/deflations may be in peristaltic pulses according to a predetermined protocol. The inflation/deflations may administer Intermittent Pneumatic Compression (IPC) protocols or sub protocols. The mode of action of the device is to empty blood from veins, in a squeezing, massaging or compression-like pulsating action, sending the blood back to the heart, which in turn pumps increased volumes of blood to the arterial system through to the capillaries and arterioles, increasing their blood flow and ability to provide oxygen to the surrounding tissues.

The mode of squeezing or compressing is specific to the present invention; the intention is to only affect the efficiency of the venous pump. Therefore the pressures exerted by the Intermittent Pneumatic Compression (IPC) or Compression sub-Protocol are between mm Hg50-30, which is below the arterial system pressure of mm Hg 80, and above the normal venous pressure mm Hg10-0.

In some embodiments of the invention, the vacuum layer is provided which is adapted to provide negative and positive pressures over the wound surface to be treated. This is especially useful in combination protocol therapies which are administered to wounds which have difficulty in healing, such as diabetic ulcers, decubitis ulcers, burn wounds and the like.

The purpose of the computerized control unit is to control the various operations of the Device. The unit comprises: A controller for controlling the various modes of operation; A vacuum/pressure pump for providing positive or negative pressure to the vacuum layer and the balloon layer for inflating or deflating, either directly or via the vacuum container; A vacuum container for releasing vacuum under command of the controller at the rate and pressure required; A servo valve for managing the airflow as required; A vibrating air-valve, whose function is to produce rapid pressure variations in the volumes of the device, under various protocols, during inflation/or deflation conditions, and/or under negative or positive pressures, according to predetermined protocols, for producing various beneficial effects on the patient's tissues.

Other optional elements may be provided, including: Mechanical vibrators for providing vibration protocols to the tissues of the patient during inflation/or deflation conditions, and/or under negative or positive pressures, according to predetermined protocols, for producing various beneficial effects on the patients tissues; Heating elements; Means for fluid perfusion of the area under treatment with fluids such as oxygen, ozone, CO, NO, saline solution, and medicated fluids.

FIG. 4 illustrates another embodiment of the device comprising a leg sleeve, including the controller unit (with its pressure pump) as described above. The system is directed towards therapy for foot ulcers, pressure wounds and venous insufficiency ulcers. Instead of, or in addition to, a pad can be used for wound treatment. The pad comprises the analogous components of the boot, including the spongy porous layer, the non permeable layer, a balloon layer, and vibrators. Some embodiments of the invention provide a pre assembled pad, and in other embodiments the pad is assembled by the caregiver from constituent components according to clinical necessity. All or any embodiments of the present invention may be assembled from kits either by the care giver or the patient.

Reference is now made to FIGS. 4*a* to 4*c* and FIG. 5 displaying schematic representations of mechanical aspects of the invention. One preferred embodiment is a Foot Treatment Device to be worn on the foot, in a shoe-like or slipper like manner. The device comprises a shoe-like element (1201 of FIG. 4*a*). This element is provided with elements capable of compressing the plantar region, inter alia. Alternatively or additionally, the device may be provided as a sleeve-like or bandage-like device (1202 of FIG. 4*a*, 1300 of FIG. 5). The sleeve- or bandage-like embodiment may be strapped to the body using Velcro 1310 straps or buckles. In all cases, the device is provided with one or more inner volumes (e.g. 1301 of FIG. 5) that are in fluid communication via pressure lines 1302 with pressure and/or vacuum reservoirs 1303. These reservoirs are kept under pressure or vacuum by means of pump 1304. Various mechanical vibrators 1305 may be embedded at various locations within the device. These vibrators may be (for example) piezoelectric, or motors with masses eccentrically mounted upon their shafts.

Figure 4A:
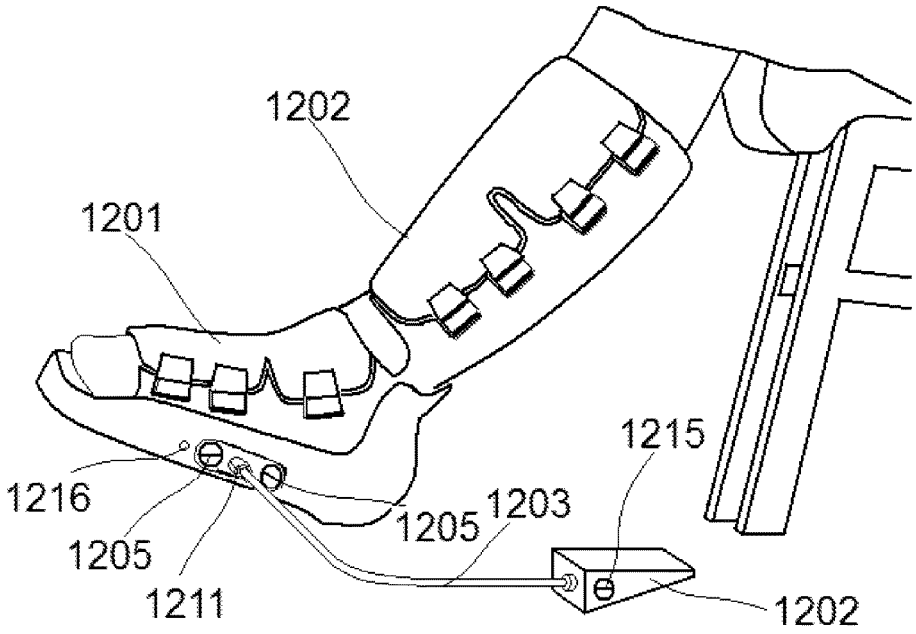
Figure 4B:
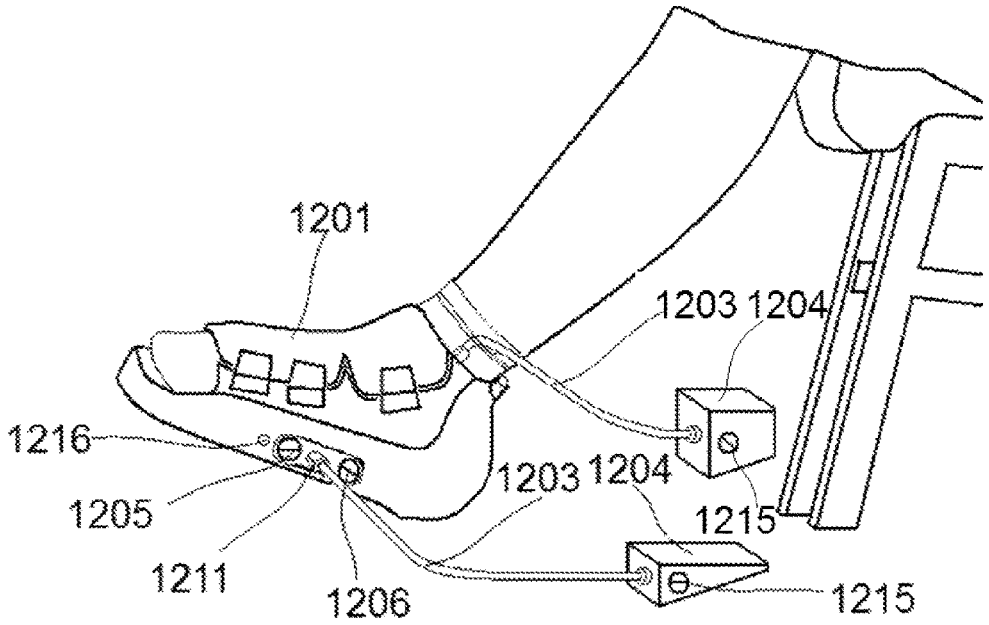

In FIGS. 4*a* to 4*c* various embodiments of the shoe 1201 and calf 1202 enclosures are provided. In FIG. 4*b* the shoe enclosure 1201 is shown alone without the calf enclosure; the device is designed such that the shoe enclosure may be used alone. A calf/foot selector 1205 selects between volumes to be inflated/deflated by connection to pump 1204. Thus for example the foot volume may be selected alone by means of selector 1205, calf volume alone, or both calf and foot volumes may be selected for inflation/deflation. A pressure selector 1206 controls the pressure supplied by the unit. This selector may be used to fix the maximum pressure attained by the device, for example allowing the user to switch between 200 mbar, 100 mbar, and 50 mbar. The pulsating unit 1204, which may also comprise a vacuum unit, connects to the shoe and calf parts through a standard hose 1203. A hose plug 1211 is provided that allows the external pressure/vacuum source to be attached. A pump control knobs 1215 control the pump operation. Indicator lights 1216 may be provided to indicate operation of the device. A pump within the shoe enclosure 1201 provides constant or slowly varying pressures, while the external pulsating units 1204 can provide swift changes in pressure. As will be obvious to one skilled in the art, both of these units may be contained within the device, or one or both may be provided external to the device.

Thus for example a user with a painful condition on the foot may choose to inflate just the calf portion of the device, by adjusting the selector 1205. If the user has a painful condition in the area of the upper ankle (such as often occurs in cases of venous insufficiency), the user may choose to use only the foot segment, again by means of selector 1205. Alternatively, the user may choose to use both segments at a pressure sufficiently reduced that it does not cause pain. This pressure control is accomplished for instance by means of the pressure selector 1206. Some embodiments of the invention are provided with an oxygen generator which is connected to the shoe enclosure by means of a hose. There are various stages in the treatment of a wound. First the wound is cleaned and then dressed with bandage. A special sock is provided with air tight inner volumes is placed over the foot and bandage. This sock is closed by means of a Velcro strip, for instance. The shoe enclosure is then attached to the foot by means of straps. Some embodiments of the device having no rigid shell and instead composed of a foldable piece of fabric.

Other embodiments of the present invention for the treatment of diabetic foot and diabetic ulcers comprise the following: a. A balloon-like member and cuff, optionally with medication and drug release capabilities; b. A pneumatic inflating pump; c. A vacuum pump; d. A large vibrator for providing vibrations of large magnitudes; e. A small vibrator for providing vibrations of small magnitudes; f. A computerised protocol controller for providing predetermined vibration protocols to the aforementioned large and small vibrators; g. A pulsating vacuum piston.

Some patients, suffering from venous insufficiency disease, often due to damaged valves in the venous system of the legs (see FIG. 1*a*), will benefit from the use of embodiments of the present invention. Others, patients who suffer from plantar ulcer but not from neuropathic anaesthesia, may not be able to withstand pain which may arise from direct squeezing of the inflatable balloon on the foot. In such cases, an inflatable/deflatable calf balloon or pad is fitted to the calf. This calf balloon is controlled by the devices to administer IPC according to protocols or sub protocols.

The vibration unit of this invention comprises: a. a plurality of regulators, each of which is adapted to define an Artificially Induced Vibration (PAID) with an individual frequency, pressure amplitude, volume, duration and waveform; b. means for producing the protocol of said defined individual PAIOs. In some embodiments of the invention abovementioned means comprises a vibrating motor or a plurality of vibrating motors; c. an effector, or a plurality of effectors adapted to introduce the protocol of produced PAIOs to impinge in or on at least at least one portion of a patient's foot and/or leg. There may be more than one effector, for example, for producing vibrations within a particular range of amplitudes and frequencies, whereas other effectors may be adapted to produce vibrations within other ranges of amplitudes and frequencies.

In some embodiments of the present invention, the protocol will be a combination of different vibrational series produced by their respective effectors. In preferred embodiments of the invention, the PAIO comprises two or more different individual PAIOs, which are administered over time. The mechanical vibrations provided may be applied directly to the patient's affected part, or they may be transmitted through inflated balloons, pads or cushions.

Figure 5:
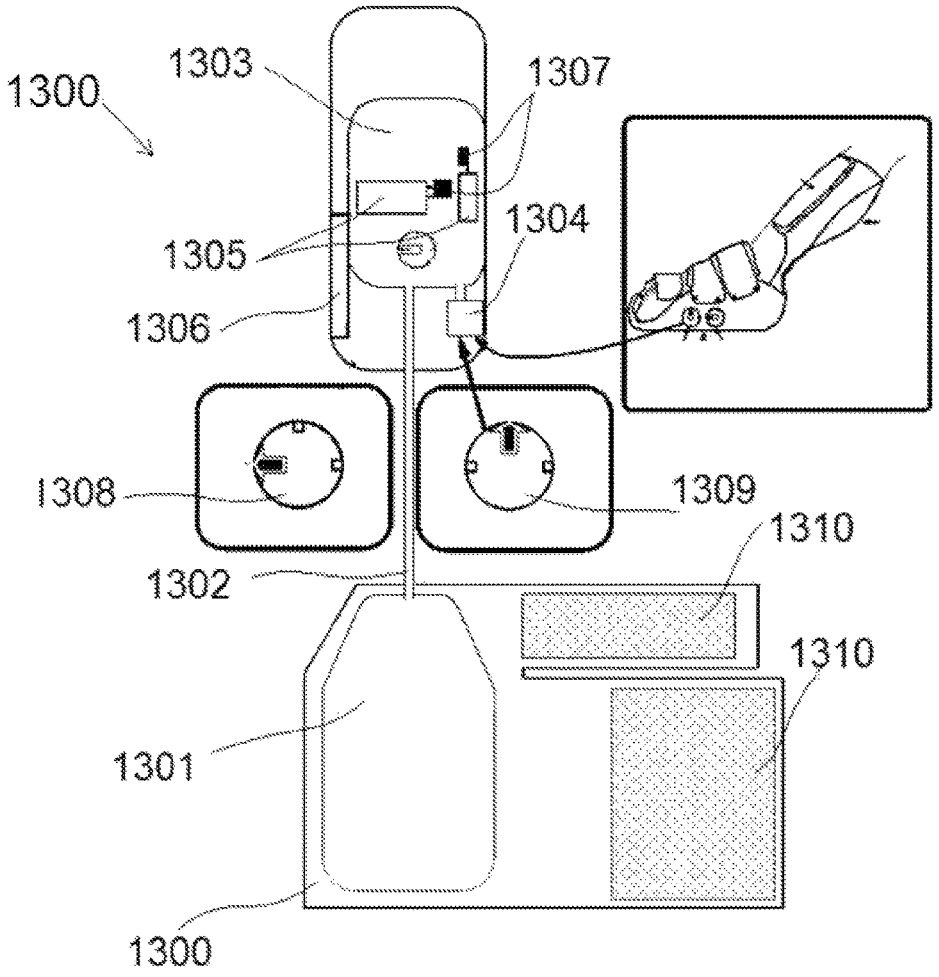
FIG. 5 illustrates another aspect of a preferred embodiment of the present invention.

Reference is now made to FIG. 5 which is a schematic representation of a preferred embodiment of the present invention. An example of an administration means is the inflatable and deflatable volume 1301. This volume may take the form of balloons or inflatable cuffs or pads which are tightly bound to the target area(s) (foot, calf). A programmed protocol of squeezing, compressing or massaging is applied by a pump 1304, controlled by a control unit 1306 (which may be a microcontroller, CPU, analog controller, or the like). The pump inflates/deflates portions of the inflatable balloons or cuffs according to certain protocols. The control unit administers a protocol controlling the operation of the pump as well as the vibrators. The vibrator in this example consists of a motor 1305 which rotates the eccentrically placed weights 1307, causing vibration. The vibrators are actuated according to the overall therapeutic protocol. The maximum pressure provided to the various body parts adjacent to the balloons can be varied.

Some embodiments of the aforementioned device are additionally provided with mechanical or electrical vibrating means for producing at least one set of predetermined high frequency humming oscillations. These humming oscillations are provided independently or contemporaneously with the series of PAIOs, and constitute part of the therapeutic protocol.

According to some embodiments of the present invention the pressure which is applied by the device may be a positive pressure or a negative pressure gradient.

An exemplary device comprises a special wearable shoe, combining several technologies which are administered by a treatment protocol, the aforementioned Treatment Protocol itself being made up of a combination of sub-protocols, to create maximum effect for treatment of foot ulcers and venous insufficiency.

The outer layer of the device comprises an inflatable and deflatable balloon-like space or pocket. The pocket may be divided into cells or compartments. The inflatable space may be pressurised and inflated by injection of fluid or gas, such that there is substantial compressive force exerted on the limb. The inflation/deflations may be in peristaltic pulses according to a predetermined protocol. The inflation/deflations may administer Intermittent Pneumatic Compression (IPC) protocols or sub protocols. The mode of action of the device is to evacuate blood from veins, in a squeezing, massaging or compression-like pulsating action, sending the blood back to the heart, which in turn pumps increased volumes of blood to the arterial system through to the arterioles and capillaries, increasing their blood flow and ability to provide oxygen to the surrounding tissues. The mode of squeezing or compressing is specific to the present invention; the intention is to only affect the efficiency of the venous pump. Therefore the pressures exerted by the Intermittent Pneumatic Compression (IPC) or Compression sub-Protocol are between MMG50-30, which is below the arterial system pressure of MMGH 80, and above the normal venous pressure MMG10-0.

An embodiment of the device has a rigid polyurethane outer shell. In some embodiments of the invention, a vacuum layer is provided which is adapted to provide negative and positive pressures over the wound surface to be treated. This is especially useful in combination protocol therapies which are administered to wounds which have difficulty in healing, such as pressure sores and diabetic ulcers, decubitis ulcers, burn wounds and the like.

The purpose of the computerized control unit is to control the various operations of the device. The unit comprises: a. A controller for controlling the various modes of operation; b. A servo valve for managing the airflow as required; c. A vibrating air-valve, whose function is to produce vibrating air, under various protocols, during inflation/or deflation conditions, and/or under negative or positive pressures, according to predetermined protocols, for producing various beneficial effects on the patient's tissues; d. Mechanical vibrators for providing vibration protocols to the tissues of the patient during inflation/or deflation conditions, and/or under negative or positive pressures, according to predetermined protocols, for producing various beneficial effects on the patients tissues.

In certain embodiments of the device, an electromagnet is connected to the piston located on the pressure line between the IPC pump and the balloon. The electromagnet governs exertion or cessation of pressure according to frequencies of the protocol selected. The movements of the piston cause pressure pulses to vibrate air in the balloon, which in turn impinges upon and affects the tissue in a predetermined manner.

In another embodiment of the invention, a gear motor is connected to the piston by means of a crank shaft located on the pressure line between the IPC pump and the balloon. The gear motor governs exertion or cessation of pressure according to frequencies of the protocol selected. The movements of the piston cause pressure pulses to vibrate air in the balloon, which in turn impinges upon and affects the tissue in a predetermined manner.

Figure 6A:
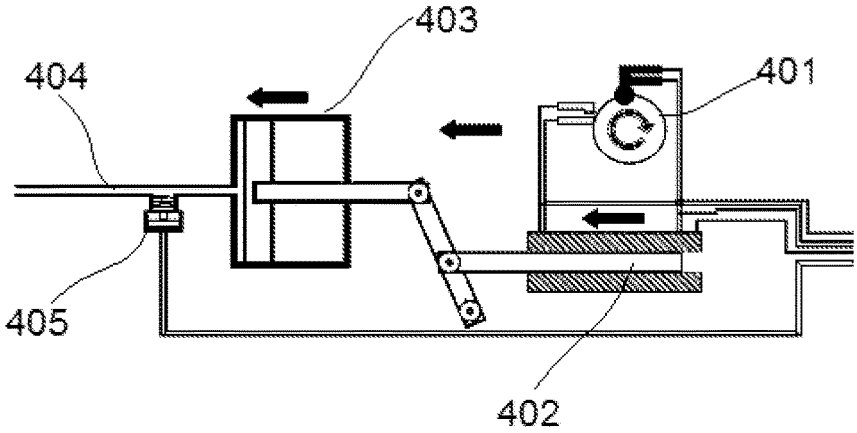
FIG. 6*a*-*c* illustrate another aspect of a preferred embodiment of the present invention.
Figure 6B:
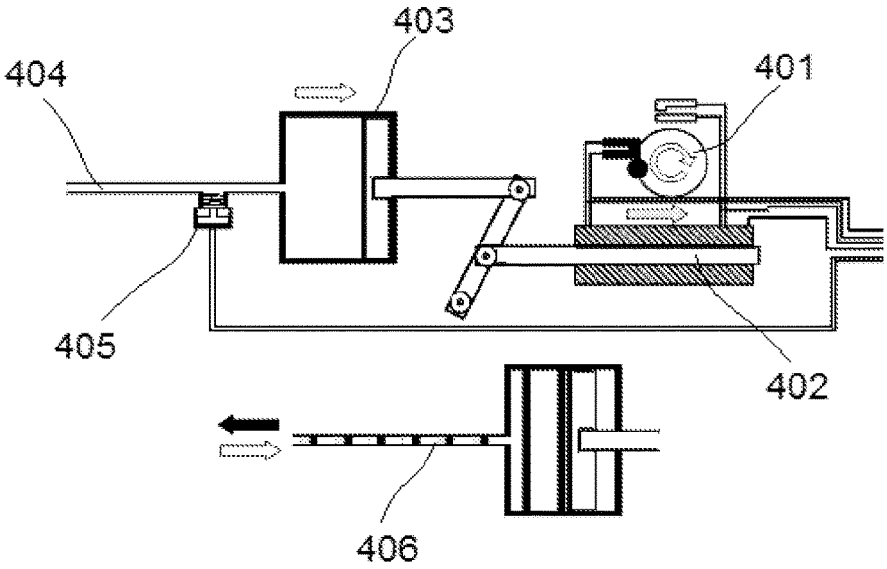
Figure 6C:
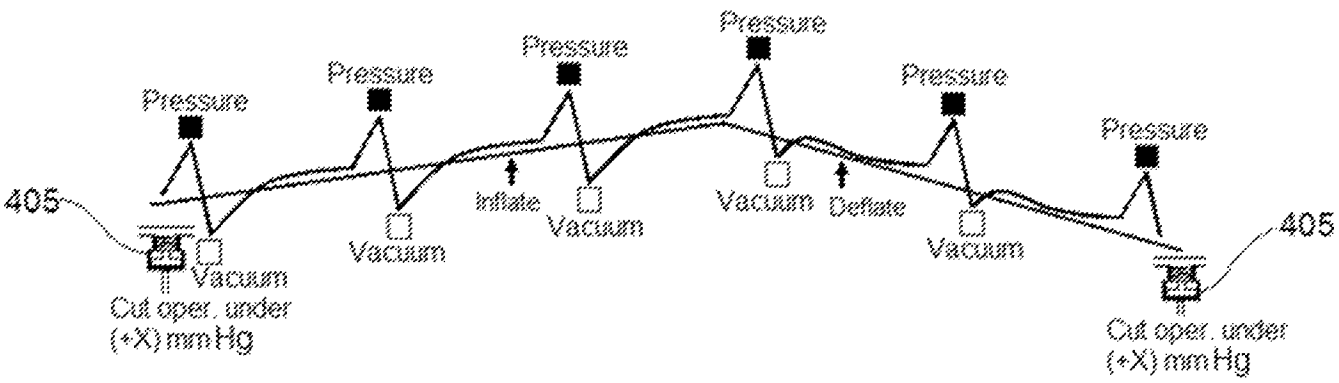

FIGS. 6*a*-6*c* present an alternative method for addition of rapid pressure and vacuum variations to a pressure/vacuum line. In this arrangement, the contactor motor 401 turns and in part of its cycle energizes the coils of electromagnetic plunger 402, which pushes piston 403 creating pressure in line 404. The auxiliary piston 405 can be used to limit minimum and maximum pressures, opening at, for example, less than 10 mmHg or greater than 2 atm. Such setpoints can be set with commercially available devices and the incorporation thereof will be clear to one skilled in the art. In FIG. 6*b* the second half of the piston stroke cycle is shown, with piston moving towards the right. In this configuration a vacuum will be created in the line 404. The net effect of continuous compression/rarefaction cycles will be as shown 406, where pulses of rarefied and compressed air will occupy the line 404. At sufficiently high frequencies, standing waves may be formed, which operation is within provision of the invention. A more complex possible waveform is shown in FIG. 6*c*. Such a waveform may be produced, for instance, by means of the secondary plunger at position 405, or by means of modulating the current sent to electromagnet plunger 402, as will be obvious to one skilled in the art. By means of this more complex waveform, novel effects can be attained in the tissues subjected to the pressure so produced. For instance, if the secondary plunger operates at a deflation speed that is more rapid than the natural speed at which human tissue can respond, the effect of a vacuum can be attained even though the absolute pressure may be greater than atmospheric. This is termed the 'rebound effect' in the remainder of this document. As will be obvious to one skilled in the art, the elastic properties of a given mass of bodily tissue, in conjunction with any pre-existing momentum, will dictate its response to a given perturbation. If said perturbation occurs more rapidly than the characteristic response time of this mass of tissue, various effects may be produced including shock waves, compression, rarefaction, and the like.

In some embodiments of the present invention an active foot rest system has been provided which moves the lower limb as a part of the treatment. In other words, the device is not worn, but the foot is rested upon or in it. Movement of the foot by the active foot rest/pedal produces alterations in the angle of the sole and heel of the foot, and alterations in the knee joint and alterations in the blood vessels and the nerves of the lower limb and foot. The angular movement of the foot produces a muscle pump effect, which is beneficial to improving the circulation. It should also be understood that alterations in the vectors within the limb upon which the aforementioned protocols act.

Yet another important embodiment of the present invention is an active foot rest system as shown in FIGS. 7*a*-7*e*. The system includes a rest for the foot designed or moulded more or less to the contours of the patient's foot and heel. The system further includes an inflatable or preformed balloon of a predetermined pressure. The system further includes an IPC operative at various controlled pressures for effecting emptying of veins and encouraging and improving arterial blood flow in the treatment portion of the limb, in order to provide therapy to the tissues while they are amply supplied with oxygen. The aforementioned system may include vibrating elements at different angles and different sizes, providing vibrations of different amplitudes, vectors and the device is adapted to provide any of the aforementioned treatment protocols.

Figure 7A:
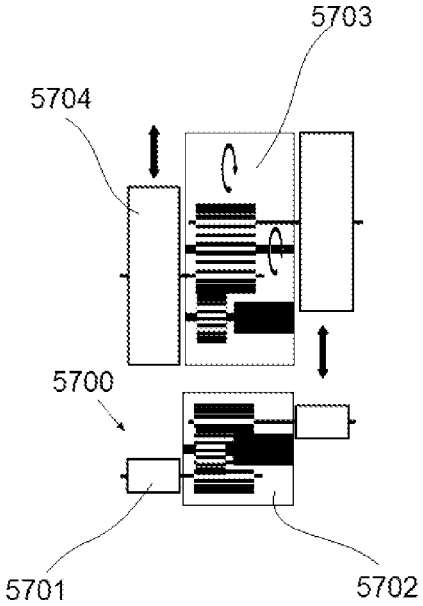
FIGS. 7*a*-7*e* illustrate another aspect of a preferred embodiment of the present invention.
Figure 7B:
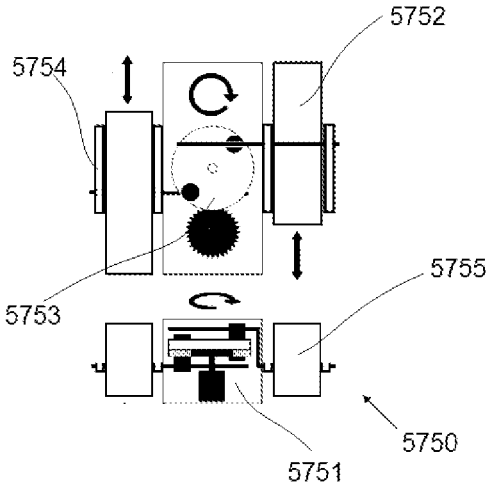

Reference is now made to FIGS. 7*a* and 7*b* in the drawings, in which an active foot rest and its components are shown in two aspects, 5700 (FIG. 7*a*) and 5750 (FIG. 7*b*), in which the foot is placed on the foot rest of the device 5705. In aspect 1, 5700 the user places his foot on the foot device seen in different positions 5701, 5704 when the device is in use. The movement of the motor and gears 5703, 5702 of 5705 are also shown in two different positions as the device is in use. Similarly, 5750 shows the active foot rest in use in two different views in which the foot device 5755, 5752 and the motor and gear, 5751 and including cogs 5753 are seen in their shifting positions.

Figure 7C:
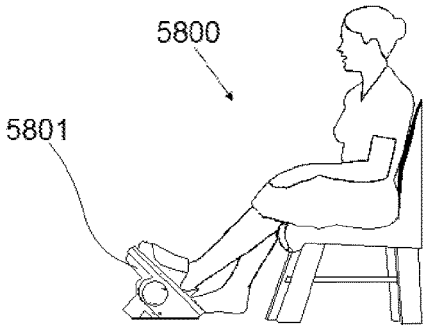
Figure 7D:
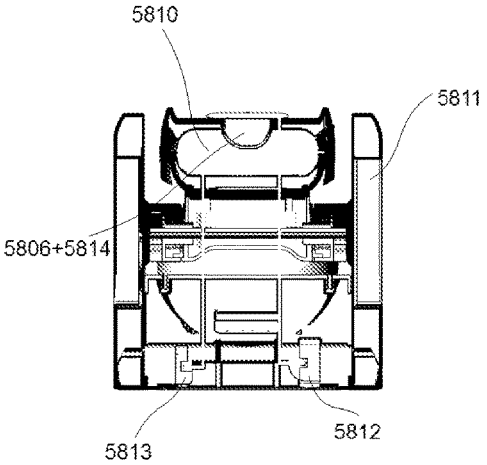
Figure 7E:
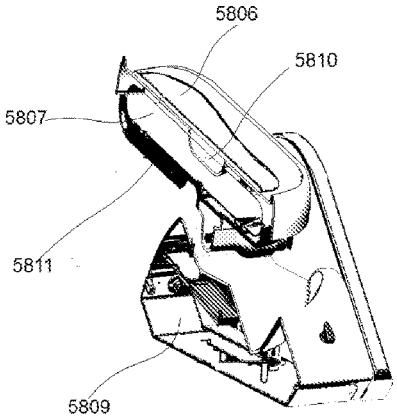

FIGS. 7*c*-7*e* illustrate a further embodiment of the present invention in use, in 5800 a Foot Treatment Device user has their foot positioned in the sleeve or bandage like embodiment at the foot 5801 and optionally and additionally at the ankle or calf. The user places their foot on the foot pad 5803 of the device and is able to use only the foot segment or both segments according to their needs by means of a selector 5804. Control of the pressure levels is achieved by means of a pressure selector 5805.

The internal components of the Foot Treatment Device are seen cross section 5820 and front view 5830, including an IPC balloon 5806, vibrator 5814 and vibrator housing 5810, foot stabilizer balloon 5811 that tracks the foot position, a foot stabilizer balloon pump 5813, IPC balloon pump 5812, batteries 5815, controllers 5809 and further pumps 5808.

Figure 8:
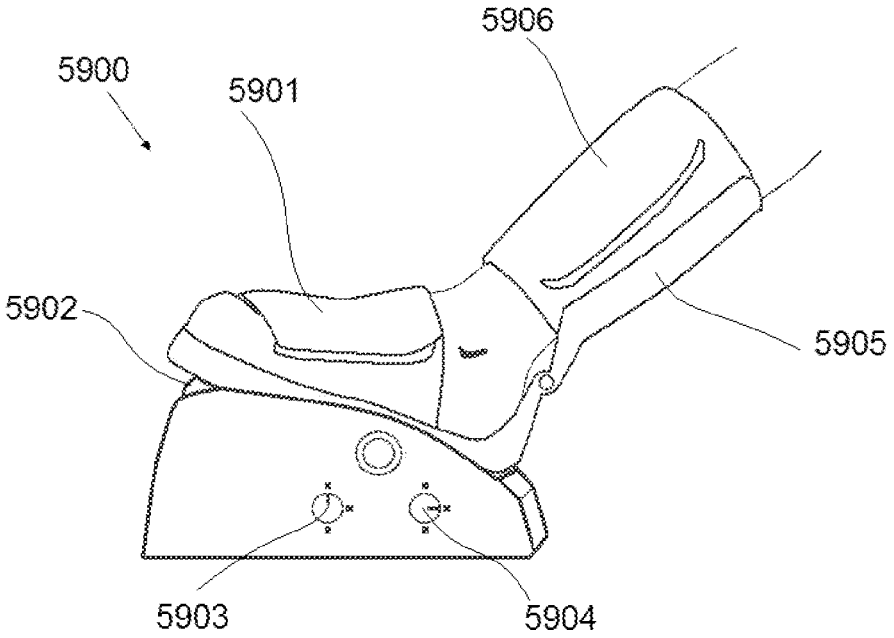
FIG. 8 illustrates another aspect of a preferred embodiment of the present invention.

Reference is now made to FIG. 8 showing another embodiment of the Foot Treatment Device 5900. In this embodiment the Foot Treatment Device comprises a foot rest or pad 5902, foot sleeve 5901 and an ankle or calf rest 5905 and sleeve 5906 for wrapping around the desired limbs. The device of FIG. 8, further incorporates a selector 5903 for choosing between activating the foot portion only or the ankle portion in addition, as well as a pressure selector 5904 for adjusting pressure levels according to the users' needs.

All of the protocols previously mentioned may be implemented by the aforementioned active foot rest system or pedal and its variants. Such devices provide optimal therapy without the patient having to do anything more strenous than sit, place his foot into or on the active foot rest, and allow the protocol to operate, possibly whilst watching TV or any other sedentary activity. Some embodiments of the invention will have the active foot rest as a pair, which will operate a type of bicycle motion, for delivering the desired angle variations as well as the vibration protocols and IPC protocols, so an overall rehabilitation of all paarts and systems of the limb is given. The bicycling motion may be automatic, power driven or power assisted or self propelled.

In FIG. 9, an example of a protocol combining inflation, vacuum, and mechanical vibration is presented when of the embodiments of the present invention is used. As can be seen in FIG. 9, the protocol session is made up of several sequences each containing aforementioned sub protocols. For convenience, only the first two sessions and the twentieth session are shown. In the example, different inflations and deflations of the Outer Balloon Layer for different durations are performed, thereby implementing Compression protocols. Mechanical vibrations sub protocols (MecP) mediated by the mechanical vibrators attached to the plantar region of the foot, and other Mechanical vibrations sub protocols attached to the calf section of the device are implemented as described herein.

Figure 10A:
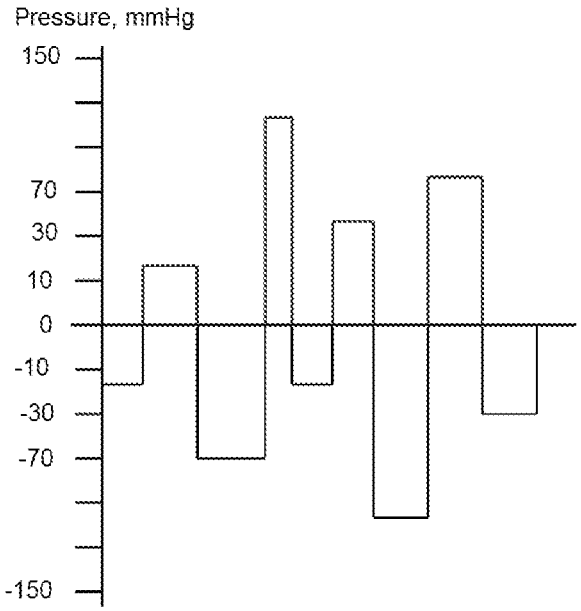
FIGS. 10*a*-10*b* illustrate another aspect of a preferred embodiment of the present invention.
Figure 10B:
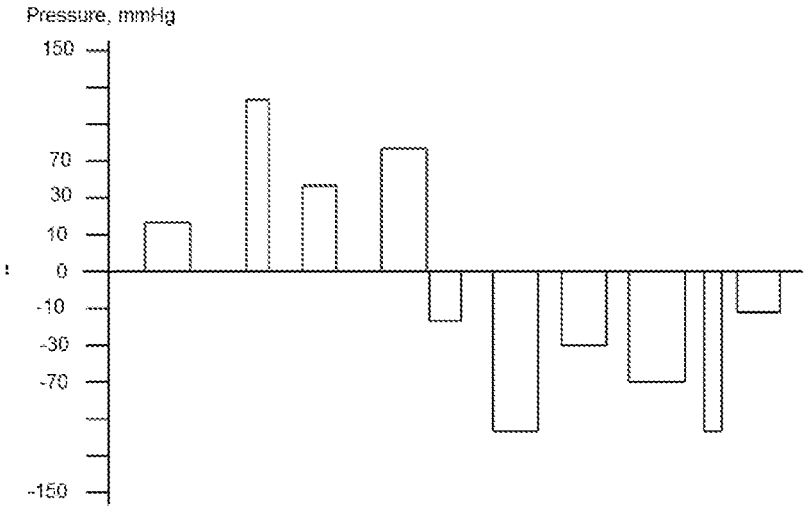

In FIGS. 10*a* and 10*b* examples of pressure/vacuum protocols are shown, with the x-axis being time and the y-axis being pressure. In FIG. 10*b* an example of a combined IPC/NPWT protocol is shown which uses the two modalities in a complementary fashion. In this case the pressures P(t) for IPC and N(t) for NPWT may be expressed as $$P(t)=\mathrm{Abs}(A_1 \sin(\omega_1 t));N(t)=-\mathrm{Abs}(A_2 \sin(\omega_2 t))$$

$$\text{Or } P(t)=\theta(\sin(\omega_1 t))A_1 \sin(\omega_1 t);N(t)=\theta(\sin(\omega_1 t))A_2 \sin(\omega_2 t)$$

Where θ is again the Heaviside step function $$\theta(x)=\begin{cases}0; x<0\\1; x>0\end{cases}$$

It is herein acknowledged that in some embodiments of the present invention, the above mentioned humming oscillations protocols comprise sequences of PAIOs. Some of the PAIOs are delivered with predetermined oscillating frequency which persist for periods of time throughout or partially throughout other sequences of PAIOs that are being delivered. Such humming oscillations can be considered to be analogous to the drone string of a Sitar which vibrates at a predetermined frequency, whilst other vibrating strings produce the tune or melody. Certain particular predetermined oscillating frequencies are useful in stimulating NO production in certain tissues, promoting gas exchange and other therapeutically useful effects. Thus, some of the protocols of the invention will include the delivery of these "drone" or "humming" vibrations as a background to and in parallel with the predetermined sequences of PAIOs. It should be emphasized that humming herein refers to mechanical vibrations, without a significant acoustic component.

In some embodiments of the invention the device is adapted for use on the limb or calf, in order to administer to the limb the aforementioned artificially induced vibrations (PAIOs) of any given frequency, pressure, amplitude, volume, duration, and waveform according to the aforementioned protocol.

Topical Oxygen Therapy, made possible by embodiments of the present invention, are herein acknowledged to be highly useful for treating diabetic foot ulcers, and also treating the sequelae of venous insufficiency. The blood supply and infection control in patients with osteomyelitis, necrotizing cellulitis and other diseases may be improved by topical oxygen therapy.

In some stages of the treatment the vacuum may be ceased, and instead, a pulse of oxygen can be introduced under pressure, for topical oxygen therapy. For the sake of clarity, the duration, timing, oxygenation and other characteristics of the aforementioned topical oxygenations will be hereinafter known as the Oxygenation Protocol (O/OP)

Likewise, at some stages of the treatment, topical application of drugs and medicaments may be administered via a supply line connected to the spongy layer, and drugs may be dispensed in a predetermined manner.

The drugs may be delivered in boli, aliquots, or continuously, or in waves, surges or pulses, according to a protocol.

For the sake of clarity, the duration, timing, strength, frequency, concentration, dosages and other characteristics of the aforementioned drug and medicament administrations will be hereinafter known as the Drug Delivery sub Protocol (DDP).

It is emphasized that no squeezing, compression or massaging pressures are exerted by the means and methods of the Compression sub-Protocol upon the arterial system. For the sake of clarity, the duration, timing, strength, periodicity, frequency and other characteristics of the aforementioned compressions will be hereinafter known as the Compression sub-Protocol (ComP), which is also to be understood to include Intermittent Pneumatic Compression (IPC) where appropriate and needed. Some embodiments of the present invention combine an intermittent compression and vacuum system with an intermittent ventilation system, which is adapted to evacuate and ventilate the enclosed limb during cycles and according to protocols.

Mechanical vibrators are positioned at predetermined locations around the body part being treated, as seen in FIG. 3 (element 407). This vibrator delivers mechanical vibrations according to a predetermined sub protocol. The specific predetermined vibrations applied to the tissue area stimulate blood perfusion, leading to lowering of tissue CO2 levels and raising of tissue O2 levels. Protocols are provided for epithelial stimulation, lymph flow stimulation, increased NO production and other therapeutic effects. The sub protocols of mechanical vibrations also vibrate blood in the arterial system all along the leg, up to the groin region and beyond, thereby aiding the blood flow to pass through blockages in these regions. The above mentioned mechanical vibrations also vibrate the bones in a predetermined manner, which in turn vibrate surrounding tissues, to beneficial effects. In embodiments of the invention Mechanical Vibrators are provided which administer the sub protocols directly to the tissue or through pneumatic media, such as the inflatable balloons, when they are pressurised, or when they are not.

In some embodiments of the present invention means and methods are provided to a wide variety of mechanical vibrations in different vectors according to the protocols of the invention: Vibrations will vary in their physiological effect on the tissues depending on the directions of the applied vibrational protocols. It is an aspect of the invention that means and methods are provided to provide protocols having different effects on tissues, cells, membranes liquids, blood vessels, organs, bones and joints. The vibrators may be positioned to satisfy the requirements of any given protocol or sub protocol, and means are provided to control the vibrators individually or in groups. In this way, different wave trains of vibrations may be sent along or through tissues, define different vectors and, where the wave trains intersect, constructive or destructive wave interference.

For the sake of clarity, the duration, timing, strength, periodicity, frequency, vectors and other characteristics of the aforementioned mechanical vibrations will be hereinafter known as the Mechanical vibration sub-Protocol (MecP) and they may also include the humming oscillations, vibrations, protocols and sub protocols as previously described and defined. In this way, circulation is encouraged, growth of new blood vessels is stimulated, and the healing of wounds and ulcers is enhanced. Another feature of the present invention allows the transfer, penetration, or transportation of drugs, gases, oxygen, ozone fluids or other gases to into the wound If medication is required, a direct line, through the sealing valve is provided for the purpose.

Table 1 (below) summarizes the above mentioned sub protocols:

| Protocol | Mediated by: |
|---|---|
| Oxygenation/Ozone (O/OP) | Oxygen/ozone supply |
| Drug Delivery (DDP) | Topical/local drug delivery protocol |
| Compression (ComP) | Balloon(s) |
| Mechanical vibrations (MecP) | Mechanical Vibrators |
| Electro therapy (EtP) (ETP) | electrodes |
| Pain Relief | combinations of above |

All or any of the above sub protocols may be combined together in any combination into a Treatment Protocol (TP), mediated by the wearable device BPE. The device is designed for use with the minimal intervention of the medical team, and a patient who is normally ambulatory will be minimally hindered during the treatment sessions, and is expected to carry out normal activities. The Treatment Protocol is tailored to particular conditions such as Peripheral Vascular Disease, Diabetic foot ulcers, Claudication, venous insufficiency, Venous insufficiency ulcers.

In one embodiment of the device, the two vibrators are operated with proportional amplitudes. The amplitudes A(t) and B(t) of two vibrators A,B are given by (for example) B(t)=k A(t). It is within provision of the invention that any of the aforementioned protocols be modulated by means of stopping the protocol periodically, for example by means of multiplying any of the preceding formulas by a square wave $\theta(\sin(\omega_0 t))$ where $\theta(t)$ is the Heaviside step function. Here the pressure is a triangle wave modulated by another triangle wave, for instance according to the expression $$P(t)=At\times\mathrm{Sgn}(\sin(\omega_1 T))+Bt\times(\sin(\omega_2 t))+C$$

The exemplary device has modes of operation which respectively enable the application of: i) pulsating, alternating, peristaltic compression and dilation of the blood vessels of the limbs and ii) mechanical vibrations applied to the plantar region of the foot or other regions of the limbs.

Using the device as described above, a combination protocol may be employed as therapy, with sub protocols of types selected from Table 1. For example, during the day, a particular tailored protocol may consist of DrP for a period, followed by MecP O/OP, then followed by DDP and ComP. The sub protocols may be applied concurrently, or in any combination, or at any interval, all according to the overall protocol selected as being best suited to the particular patient's condition or illness. The design of the device and the design of the protocols and sub protocols enable a plurality of treatments and protocols and sub protocols to be carried out whilst the patient is awake and in motion or at rest or whilst the patient is asleep. In summary, the device is a structure which provides beneficial effects on both macrovascular (arteries), microvascular (capillaries) levels, and on the venous system.

The device is adapted for administering intermittent pneumatic compression (IPC) and artificially induced oscillations (PAID) useful in alleviating peripheral circulatory disorders of a patient's limb and in wound healing in any body organ, comprising a wearable body portion enclosure (BPE) adapted to contact areas of the body, said BPE comprising: one or more inflatable balloons or balloon layers adapted to be inflated and deflated; one or more pressure sources in fluid communication with said balloons by way of one or more valves; one or more vibrating elements adapted to produce artificially induced oscillations; a controlling unit adapted to inflate and deflate said balloons by means of said valves, and operate said vibrating elements; whereby IPC and PAIO may be individually administered to said areas of the body according to predetermined protocols.

The control unit has a vacuum container, pressure/vacuum pump, servo valve and air pulsating valve and a container for oxygen ozone or drugs and medicaments in any convenient form. Various connection lines supply pressure, sealing inflation pressure vacuum, ventilation, oxygen, drugs ozone and temperature control to the pressure therapy boot. The unit is controlled by the patient or caregiver. The boot may comprise: the sealing pressure layer, the pressure layer, the vacuum layer the heating layer, and a sponge layer. Such an alternating pressure therapy system is unique in its structural and functional features which enable, for the first time, highly controlled multiple treatments to be administered.

In one embodiment of the device directed towards treatment of diabetic foot ulcers, an additional detachable sleeve for the treatment of venous insufficiency is provided. Modes of this embodiment can be for prevention or microvascular/macrovascular treatment, PAD, venous insufficiency, and drug delivery. It will be appreciated by those skilled in the art that disposable dressings can be supplied as components of the device, and that, in some embodiments of the invention, other components of the device are disposable or for single use.

A major principle of the present invention are means and methods of inducing vacuum pulses and pressure pulses on tissues, in order to exert physiological effects. When a sudden or abrupt high pressure pulse impinges a tissue, the tissue is displaced (a), and a physiological response, change or effect is brought about. When the high pressure pulse is released, the tissue will relax and is no longer displaced. Another physiological response, change or effect at the cellular level or at the tissue level occurs as a consequence. Yet another HPR is envisaged if, instead of the exerted pressure dropping merely to the basal level, a vacuum pulse is exerted so that the tissue undergoes a larger pressure gradient from a positive pressure to a negative pressure, and a corresponding larger displacement and rebound of the tissue, with enhanced HPR, changes in pressure from low pressure to high pressure and back as pressure pulses and vacuum pulses are applied to the tissue. Certain embodiments of the invention provide means of increasing overall or basal pressure on the tissue or body part, over which protocols of high and low pressure may be superimposed. Such an embodiment is exemplified by a vacuum and pressure producing means producing vacuum or pressure over the body part to be treated. The aforementioned vacuum and pressure producing means is itself covered by an inflatable/deflatable balloon which provides a selectable overall or basal pressure. The base pressure itself of course may be varied during the course of the treatment.

Figure 11:
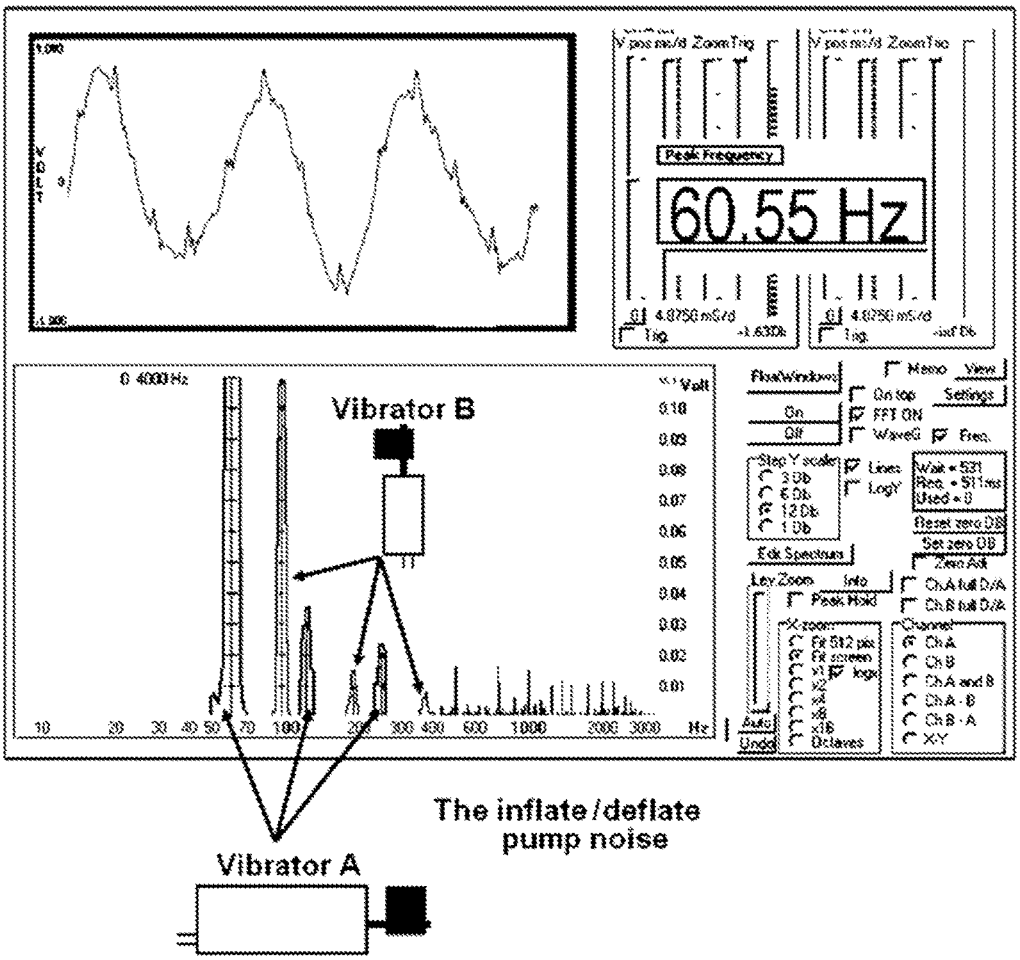
FIG. 11 illustrates another aspect of a preferred embodiment of the present invention.

Example of vibration protocol using two vibrating elements: The ratio between the two vibrators amplitudes and weights are designed such as to create a ratio of 1.5747 between the vibrational frequencies of the two vibrating elements. The ratio chosen may for instance be an approximation to a root of a natural number, a whole-number ratio, or any other ratio. This is done to achieve specific effects on the tissue and on the blood vessels. Other protocols, frequencies, amplitudes/weights, and ratios will achieve different effects. As seen in FIG. 11, a fundamental frequency of 60.55 Hz is elicited in one vibrating elements while a frequency of 95.3 is elicited in the second vibrating element. The harmonics of these frequencies (at 121 Hz, 191 Hz, etc) are seen as well. The FIG. 11 shows recordings of the vibrations in the tissue, created by an example of the protocol used; the first step involves applying 35.1 Hz. The second step involves applying a frequency of 46.88 Hz. The third step involves applying a vibration frequency of 64.45 Hz.

It is within provision of the device to compress the body portion being treated, then during relaxation of this pressure, to expose the body portion to a fluid such as oxygen. Upon the next cycle of compression, this fluid is then forced into the tissue exposed thereto, facilitating increased rates of exchange between the tissue and the fluid thus introduced.

Example of an experiment: The Effect of Vibrating the Calf Muscle at 15 Hz on the Blood Flow in the Popliteal Vein (19 Jan. 2004)

Purpose of the study: to evaluate preliminarily the effect of vibrating the calf muscle on the blood flow in the popliteal vein.

Methods: A 49 years old male volunteer heavy smoker with no known peripheral vascular disease was exposed to mechanical vibrations at 15 Hz administered to his right calf muscle by wrapping his calf by a tight sleeve and placing a vibrator between the calf and the sleeve. Blood flow and blood flow velocity were measured in the popliteal vein, using echo Doppler, with its probe placed over the popliteal vein, as shown on the adjacent picture.

Results: A rise of 18% in the blood flow (from 166.8 ml/min to 196.5 ml/min) was measured, together with an almost identical (17.8%) parallel rise in the blood flow velocity (from 100% to 117.8%). When the vibrations were stopped the blood flow returned to about 80% of baseline, and when vibrations were resumed, the blood flow and blood flow velocity rose again to their previous high values. These data are depicted in the following table and chart. Echo Doppler documentation of the raw data is shown on the following pages.

TABLE 2

| | | | Velocity Flow (VF) | |
|---|---|---|---|---|
| | Vibrations* | Time | ml/min | % of baseline |
| 1 | OFF (baseline) | 09:31 | 166.8 | 100.0 |
| 2 | ON | 10:13 | 196.5 | 117.8 |
| 3 | ON | 10:46 | 196.5 | 117.8 |
| 4 | OFF | 11:15 | 157.2 | 94.2 |
| 5 | ON | 11:22 | 196.5 | 117.8 |
| 6 | OFF | 11:49 | 150.0 | 89.9 |

*Vibrations: ON = vibrations applied; OFF = no vibrations applied

Figure 12:
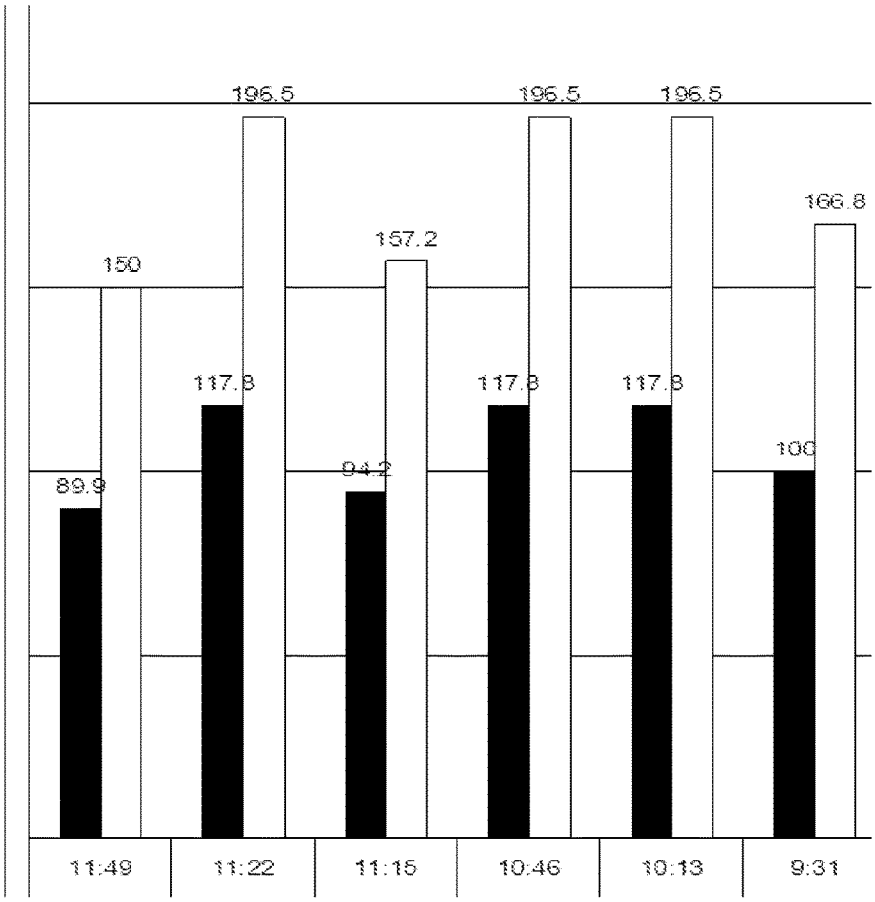
FIG. 12 illustrates another aspect of a preferred embodiment of the present invention.

FIG. 12 shows results of this study. In this study, the ultrasound probe was used against the popliteal vein. As can be seen from FIG. 12, there is a close correlation between the 15 Hz vibration windows and measured parameters of blood flow, velocity. FIG. 12 shows ultrasound measurements of the popliteal vein before, during, and after treatment with 15 Hz vibration.

CONCLUSIONS

Vibrating the calf muscle produces a rise of blood flow, which lasts as long as the vibrations are administered. An overshoot effect when stopping the vibrations to a level of blood flow lower than the baseline may be explained by the relaxation of the calf muscles which reduces the peristaltic force on the blood in the veins.

The following documents are incorporated here by a reference: provisional application No. 61/250,526 titled "MEANS AND METHODS OF ALLEVIATING PERIPHERAL CIRCULATORY DISORDERS", provisional application No. 61/367,423 titled "MEANS AND METHODS OF ALLEVIATING PERIPHERAL CIRCULATORY DISORDERS", provisional application No. 61/250,527 titled "ALTERNATING PRESSURE DEVICE", provisional application No. 61/370,859 titled "ACTIVE FOOT REST AND OTHER DEVICES FOR FUNCTIONAL REVASCULARIZATION".

The invention claimed is:

1. A device for administering intermittent pneumatic compression; said device wearable on a patient's body portion to be treated; said device comprising:

a) an inner flexible porous spongy layer adapted to be attached to said patient's skin;

b) a middle non-permeable layer adapted to be sealingly attached to said patient's skin;

c) at least one inflatable-deflatable first balloon;

d) at least one vibrating element;

e) an outer enclosure accommodating items from a to d;

f) a controlling unit adapted to operate at least one pressure source, and to operate said at least one vibrating element; and g) at least one of the following: a pump for producing positive pressure pulses and a vacuum pump for producing negative pressure pulses within said at least one first balloon;

wherein said outer enclosure is provided with a second balloon along a periphery thereof; said second balloon being inflated seals a space between said outer enclosure and the patient's body portion to be treated.

2. The device of claim 1, wherein at least one of the following is true:

a) said outer enclosure takes a form selected from the group consisting of: sock, boot, shoe, sandal, bandage, pad, dressing, cast, flexible cast, shirt, girdle, pants, shorts, sleeve, tube;

b) said patient's treated organ is selected from the group consisting of: a foot, a plantar aspect of the foot, an ankle, a knee, a calf, a thigh, an abdomen, a gluteal region, a back, a chest, a hand, an arm, a nose, a neck, a shoulder, and an elbow, c) the device is additionally provided with a selector adapted to open and close one or more one valve, thereby selecting one or more of said at least one first balloon to be put in fluid communication with said at least one of said pump for producing positive pressure pulses and vacuum pump for producing negative pressure pulses, d) said inner flexible porous spongy layer is adapted to allow forced fluid exchange with a fluid supply, e) said fluid being selected from the group consisting of: oxygen, ozone, NO, air, vacuum, medicated fluids, saline solution and Ringer Lactate solution, f) the device is provided with said inner flexible porous spongy layer comprised of a biocompatible foam, g) said device comprises said outer enclosure structurally based on biocompatible medical foams which set in situ.

3. The device of claim 1, wherein at least one of the following is true:

a) said device is additionally provided with sensors selected from a group consisting of: temperature sensors, tissue oxygenation sensors, tissue $CO_2$ level sensors, P(NO) sensors, $P(O_3)$ sensors, systolic blood pressure sensors, diastolic blood pressure sensors, blood flow rate sensors, humidity sensors, blood viscosity sensors, blood perfusion sensors, conductivity sensors, and voltage sensors, and b) said device is further provided with electrodes adapted for stimulating said patient's skin with electrical voltage.

4. The device according to claim 1, wherein at least one of the following is true:

a) said at least one vibrating elements is operated at a set of frequencies ranging from about 0.5 Hz to about 500 Hz, b) said at least one vibrating element operates independently or contemporaneously with a series of negative and positive pressure pulses.

5. The device according to claim 1, wherein a range of operating frequency of said negative and positive pressure pulses is selected from a group consisting of about 0.5 Hz to about 5.0 Hz, about 5.0 Hz to about 10 Hz, about 10 Hz to about 20 Hz, about 20 Hz to about 30 Hz, about 30 Hz to about 40 Hz, about 40 Hz to about 50 Hz, about 50 Hz to about 60 Hz, about 60 Hz to about 70 Hz, about 70 Hz to about 80 Hz, about 80 Hz to about 90 Hz, and about 90 Hz to about 100 Hz.

6. The device according to claim 1, additionally comprising an external supplementary layer including a plush sponge wherein said plush sponge is adapted such that mechanical vibrators is inserted into said external supplementary layer.

7. The device according to claim 1, wherein at least one of the following is true:

a) said device is further adapted to move a lower limb of the patient in a predetermined manner as part of a treatment, and further including an active foot rest is adapted to produce alterations of an angle of a foot joint or a knee joint, b) said device is provided with a foot device and adapted such that an angular movement of a foot produces a muscle pump effect, beneficial to improve the patient's circulation when the patient places his foot on the foot device during use, c) said device is provided with motor and gears, said device is adapted such that the patient places his foot on a foot pad of the device and is able to select only a foot segment or both lower limb and foot segments of the device according to need by means of a selector and control of pressure levels is achieved by means of a pressure selector.

8. The device of claim 1, wherein the device is additionally provided with a selector adapted to open and close one or more valve, thereby selecting one or more of said at least one first balloons to be put in fluid communication with one of said pumps for producing negative or positive pressure pulses.

9. The device of claim 8, wherein at least one of the following is true:

a) a fluid is pumped into said inner flexible porous spongy layer during periods of low pressure in an outer layer, causing said fluid to be forced into said body part during periods of high pressure in said outer layer, b) said device is adapted for topical hyperbaric oxygen therapy.

10. The device according to claim 8, wherein pressure is applied in a direction largely normal to a body part; said device additionally comprises an external supplementary layer including a plush sponge, wherein vibrators are inserted into said external supplementary layer; said device is adapted for increasing diffusive fluxes by means of creating spatial pressure gradients with one of said pumps.

11. The device according to claim 1, wherein a vibration frequency of said at least one vibrating element is selected from a group consisting of about 0.5 Hz to about 5.0 Hz, about 5.0 Hz to about 10 Hz, about 10 Hz to about 20 Hz, about 20 Hz to about 30 Hz, about 30 Hz to about 40 Hz, about 40 Hz to about 50 Hz, about 50 Hz to about 60 Hz, about 60 Hz to about 70 Hz, about 70 Hz to about 80 Hz, about 80 Hz to about 90 Hz, and about 90 Hz to about 100 Hz.

12. The device of claim 1, wherein at least one of the following is true:

a) said device further comprises electrodes adapted for electrical stimulation of a body part, b) said device further comprises a heater for heating said body part, c) said heater is selected from the group consisting of: an electrical heater and a chemical heater.

* * * * *